US008571461B2

(12) United States Patent
Ohnishi

(10) Patent No.: US 8,571,461 B2
(45) Date of Patent: Oct. 29, 2013

(54) IMAGE FORMING APPARATUS

(71) Applicant: KYOCERA Document Solutions Inc., Osaka (JP)

(72) Inventor: Yuzo Ohnishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/743,249

(22) Filed: Jan. 16, 2013

(65) Prior Publication Data

US 2013/0127111 A1 May 23, 2013

Related U.S. Application Data

(62) Division of application No. 12/776,205, filed on May 7, 2010, now abandoned.

(30) Foreign Application Priority Data

May 11, 2009 (JP) ..... 2009-114242

(51) Int. Cl.
*G03G 15/00* (2006.01)

(52) U.S. Cl.
USPC ..... 399/405; 399/82; 399/85

(58) Field of Classification Search
CPC ..... G03G 15/6573; G03G 2215/00675
USPC ..... 399/405, 85, 82
See application file for complete search history.

(56) References Cited

U.S. PATENT DOCUMENTS

| | | | | |
|---|---|---|---|---|
| 4,251,000 | A | 2/1981 | Templeton | |
| 6,250,631 | B1 * | 6/2001 | Hanamoto et al. | 271/298 |
| 7,063,317 | B2 | 6/2006 | Sato et al. | |
| 7,355,730 | B2 | 4/2008 | Landau et al. | |
| 2008/0031652 | A1 | 2/2008 | Yoda | |

FOREIGN PATENT DOCUMENTS

| | | |
|---|---|---|
| JP | 63-316873 A | 12/1988 |
| JP | H08-192947 | 7/1996 |

OTHER PUBLICATIONS

Notice of Reasons for Rejection issued to corresponding JP Application No. 2009-114242, mailed Feb. 5, 2013.

* cited by examiner

*Primary Examiner* — Daniel J Colilla
*Assistant Examiner* — Blake A Tankersley
(74) *Attorney, Agent, or Firm* — Knobbe Martens Olson & Bear LLP

(57) ABSTRACT

An image forming apparatus includes a first and second ejection portions, a first and second conveying paths, a branch portion connecting the first conveying path with the second conveying path, a switching member movable between a first and second positions, a drive unit that moves the switching member from the first position to the second position or vice versa, a reference position setting unit setting the reference position of the switching member in an initial state, and a control unit controlling the drive unit such that the switching member in the initial state is positioned at the reference position set by the unit.

6 Claims, 9 Drawing Sheets

FIG. 5

633

| DATE AND TIME | EJECTION PORTION USED | NUMBER OF SHEETS EJECTED |
|---|---|---|
| ⋮ | ⋮ | ⋮ |
| APRIL5 ~ APRIL11 | FIRST EJECTION PORTION | 235SHEETS |
| APRIL5 ~ APRIL11 | SECOND EJECTION PORTION | 211SHEETS |
| APRIL12 ~ APRIL18 | FIRST EJECTION PORTION | 54SHEETS |
| APRIL12 ~ APRIL18 | SECOND EJECTION PORTION | 357SHEETS |
| APRIL19 ~ APRIL25 | FIRST EJECTION PORTION | 411SHEETS |
| APRIL19 ~ APRIL25 | SECOND EJECTION PORTION | 23SHEETS |
| ⋮ | ⋮ | ⋮ |

IMAGE FORMING APPARATUS

This application is a divisional application of U.S. patent application Ser. No. 12/776,205, filed May 7, 2010 which claims the benefit of Japanese Patent Application No. 2009-114242, filed May 11, 2009. This application incorporates herein by reference U.S. patent application Ser. No. 12/776,205 and Japanese Patent Application No. 2009-114242 in their entirety.

BACKGROUND OF THE INVENTION

1. Field of the Invention

The present invention relates to an image forming apparatus such as a printer, a copy machine, and the like.

2. Related Art

In recent years, an image forming apparatus such as a printer, a copy machine and the like have a plurality of ejection portions. Such an image forming apparatus can eject paper on which an image is formed from different ejection portions.

As the abovementioned image forming apparatus, an image forming apparatus has been known that includes: a first ejection portion; a second ejection portion; a first conveying path that guides paper on which an image is formed toward the first ejection portion; a second conveying path that guides paper on which an image is formed toward the second ejection portion; a branch portion that connects the first conveying path with the second conveying path; a switching member that is disposed in the branch portion and switches between conveying paths in which the paper is conveyed; and a solenoid that operates the switching member.

SUMMARY OF THE INVENTION

However, in such an image forming apparatus, a switching sound such as sound generated upon turning on and off of the solenoid, sound generated due to contact between the switching member and peripheral members and the like, is generated upon moving the switching member from a reference position initially set before shipment, due to switching operation of the switching member. In addition, if the switching operation (moving) of the switching member is frequently performed, the solenoid and the switching member may deteriorate.

The present invention is aimed at providing an image forming apparatus that is provided with a switching member that switches a conveying direction of paper and that can change a reference position, which is a position at which the switching member is positioned when the image forming apparatus is turned on.

The present invention relates to an image forming apparatus comprising: a housing; an image forming unit that forms an image on a recording medium to which the image is transferred; a first ejection portion and a second ejection portion that eject the recording medium to the outside of the housing; a first conveying path that guides the recording medium to the first ejection portion; a second conveying path that guides the recording medium to the second ejection portion; a branch portion that connects the first conveying path with the second conveying path; a switching member that is disposed in the branch portion and movable between a first position to direct the recording medium, which is discharged to the outside of the apparatus, toward the first conveying path, and a second position to direct the recording medium, which is discharged to the outside of the apparatus, toward the second conveying path; a drive unit that moves the switching member from the first position to the second position or from the second position to the first position; a reference position setting unit that sets a reference position of the switching member in an initial state; and a control unit that controls the drive unit such that the switching member in the initial state is positioned at the reference position set by the reference position setting unit.

It is preferable that a usage status storage portion that stores usage information including information regarding a position of the switching member is further included, and that the reference position setting unit sets the reference position of the switching member based on the usage information stored by the usage status storage portion.

It is preferable that a usage information collection period setting unit is further included, that can set a collection period, which is a predetermined period for collecting the usage information, and that makes the usage information, in the collection period set by the usage information collection period setting unit, stored in the usage status storage portion.

It is preferable that the usage information collection period setting unit shortens or prolongs the collection period in a case where usage frequency of the first ejection portion or the second ejection portion in the collection period is within a predetermined range.

It is preferable that a number information acquisition unit is further included that obtains number information relating to a number of the recording mediums ejected from the first ejection portion and a number of the recording mediums ejected from the second ejection portion, and that the reference position setting unit sets the reference position of the switching member based on the number information obtained by the number information acquisition unit.

It is preferable that a change operation unit is further included that can instruct the reference position setting unit to change the reference position.

It is preferable that a noise information acquisition unit is further included that obtains noise information based on first switching sound generated when the switching member is moved from the first position to the second position, and second switching sound generated when the switching member is moved from the second position to the first position, and that the reference position setting unit refers to the noise information obtained from the noise information acquisition unit, and sets the first position as the reference position in a case where the first switching sound is louder than the second switching sound, and sets the second position as the reference position in a case where the second switching sound is louder than the first switching sound.

In addition, it is preferable that a specification unit that can specify the position of the switching member; and a number specification unit that specifies a number of the recording mediums on which an image is to be formed by the image forming unit at the position specified by the specification unit are further included, and that the control unit controls the drive unit to maintain the switching member at the position specified by the specification unit until the number of the recording mediums specified by the number specification unit is carried into the first conveying path or the second conveying path by the switching member.

According to the present invention, an image forming apparatus that is provided with a switching member that switches conveying direction of paper and that can change the reference position, which is a position at which the switching member is positioned when the image forming apparatus is turned on can be provided.

BRIEF DESCRIPTION OF THE DRAWINGS

FIG. 5 is a diagram illustrating a number management table storage portion 633 in a usage status storage portion 632 shown in FIG. 4;

DETAILED DESCRIPTION OF THE INVENTION

Embodiments of the image forming apparatus according to the present invention are described hereinafter with reference to the drawings.

Figure 1:
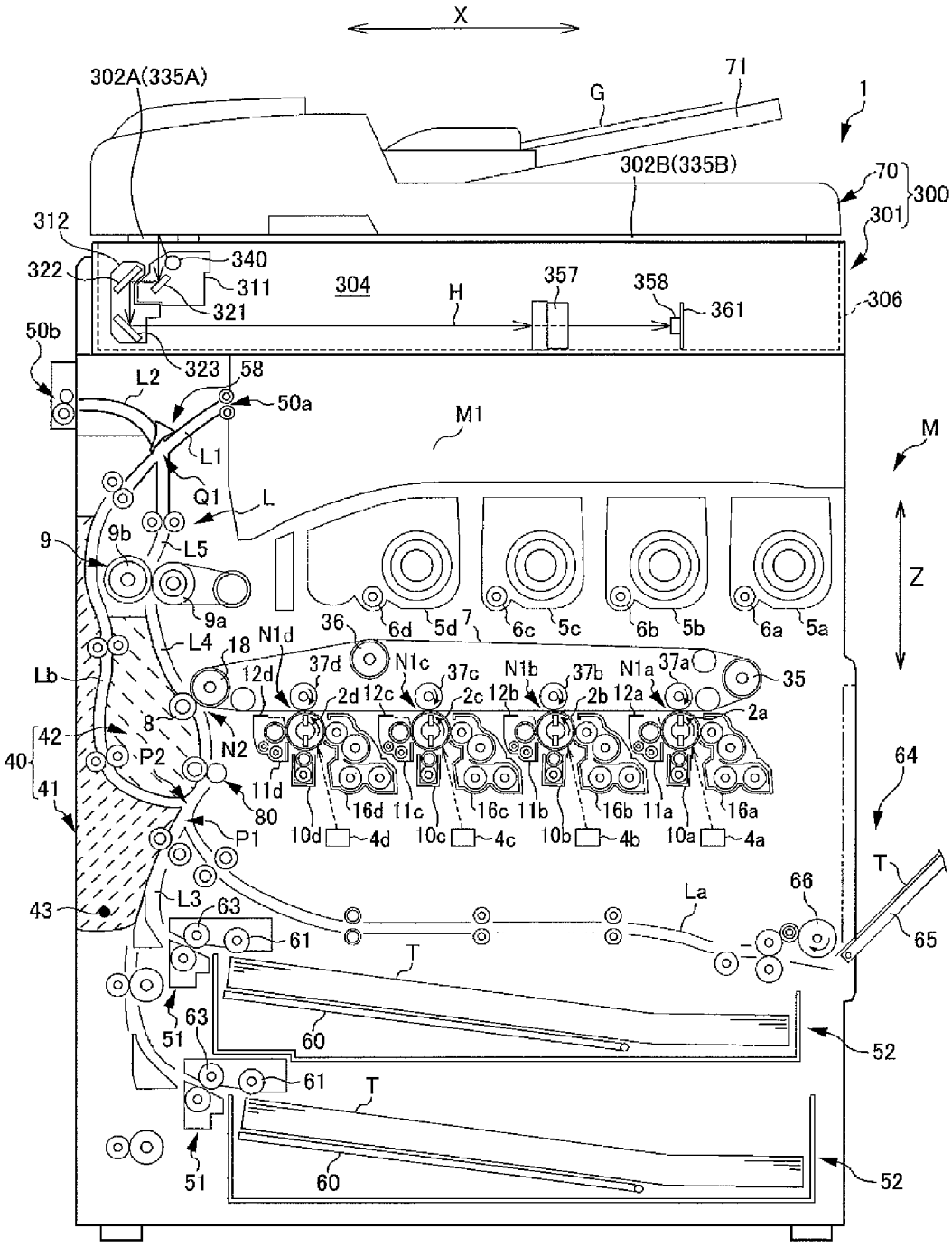
FIG. 1 is a diagram illustrating an arrangement of components of a copy machine 1.

An overall structure of a copy machine 1 as an image forming apparatus according to the present embodiment is described referring to FIG. 1. FIG. 1 is a diagram illustrating an arrangement of each component of the copy machine 1.

As shown in FIG. 1, the copy machine 1 as the image forming apparatus includes an image reading apparatus 300 disposed on an upper side thereof in a vertical direction Z, and an apparatus main body M disposed on a lower side thereof in the vertical direction Z. An apparatus main body M forms a toner image on a paper T, as a recording medium to which the image is transferred, based on image information read by an image reading apparatus 300.

It should be noted that, in the description of the copy machine 1, a sub-scanning direction X is also referred to as "right and left direction" and a main scanning direction Y (a direction across FIG. 1) is also referred to as "back and forth direction" of the copy machine 1. The vertical direction Z of the copy machine 1 is orthogonal to the sub-scanning direction X and the main scanning direction Y.

First, the image reading apparatus 300 is described.

As shown in FIG. 1, the image reading apparatus 300 includes a flap member 70 and a reader unit 301 that reads an image on an original G.

The flap member 70 is connected with the reader unit 301 by means of a connecting portion (not shown) so as to be openable and closable. The flap member 70 protects a reading surface 302A (described later) while holding the original.

The reader unit 301 includes a housing 306 and the reading surface 302A, which is disposed on an upper side of the housing 306. In addition, the reader unit 301 includes, in an internal space 304 of the housing 306, an illumination unit 340 including a light source disposed, a plurality of mirrors 321, 322, and 323, a first frame body 311 and a second frame body 312 that move in the sub-scanning direction X, an imaging lens 357, a CCD 358 having a reading function, and a CCD substrate 361. The CCD substrate 361 performs a predetermined process with respect to image information read by the CCD 358 and outputs the image information to the apparatus main body M. The illumination unit 340 and the mirror 321 are housed in the first frame body 311. The second mirror 322 and the third mirror 323 are housed in the second frame body 312.

The reading surface 302A spreads in a direction orthogonal to the sub-scanning direction X and the main scanning direction Y, and occupies a large part of an upper face of the reader unit 301. The original G is disposed on the reading surface 302A. The first frame body 311 and the second frame body 312 move in the sub-scanning direction X while maintaining a length of a light path H (described later) constant. As a result, an image of the original G placed on the reading surface 302A is read.

In the internal space 304 of the housing 306, the plurality of mirrors 321, 322 and 323 forms the light path H so that light which irradiated from the illumination unit 340 to the original G and reflected by the original G is incident upon the imaging lens 357. In addition, the first frame body 311 moves in a sub-scanning direction X at a predetermined speed A while the second frame body 312 moves in the sub-scanning direction X at the predetermined speed A/2. Therefore, the length of the light path H is kept constant even while reading an image.

Next, the apparatus main body M is described.

The apparatus main body M includes an image forming unit for forming a predetermined toner image on the paper T on the basis of predetermined image information, and a paper feeding/ejection portion for feeding the paper T to the image forming unit and ejecting the paper T on which a toner image is formed.

As shown in FIG. 1, the image forming unit includes photoreceptor drums 2*a*, 2*b*, 2*c*, and 2*d* as image carriers (photogreceptor), charging units 10*a*, 10*b*, 10*c*, and 10*d*, laser scanner units 4*a*, 4*b*, 4*c*, and 4*d* as exposure units, developing units 16*a*, 16*b*, 16*c*, and 16*d*, toner cartridges 5*a*, 5*b*, 5*c*, and 5*d*, toner feeding units 6*a*, 6*b*, 6*c*, and 6*d*, drum cleaning units 11*a*, lib, 11*c*, and 11*d*, static eliminator 12*a*, 12*b*, 12*c*, and 12*d*, an intermediate transfer belt 7, primary transfer rollers 37*a*, 37*b*, 37*c*, and 37*d*, a secondary transfer roller 8, an opposing roller 18, and a fixing device 9.

As shown in FIG. 1, the paper feeding/ejection portion includes a paper feeding cassette 52, a manual feeding portion 64, a conveying path L for the paper T, a resist roller pair 80, a first ejection portion 50*a*, and a second ejection portion 50*b*. It should be noted that the conveying path L is a collective of a first conveying path L1, a second conveying path L2, a third conveying path L3, a fourth conveying path L4, a fifth conveying path L5, a manual conveying path La, and a reverse conveying path Lb.

Components of the image forming unit and the paper feeding/ejection portion are described in detail hereinafter.

First, a description is provided for the image forming unit.

In the image forming unit, charging by the charging units 10*a*, 10*b*, 10*c*, and 10*d*, exposure by the laser scanner units 4*a*, 4*b*, 4*c*, and 4*d*, development by the developing units 16*a*, 16*b*, 16*c*, and 16*d*, primary transfer by the intermediate transfer belt 7 and the primary transfer rollers 37*a*, 37*b*, 37*c*, and 37*d*, static elimination by the static eliminators 12*a*, 12*b*, 12*c*, and 12*d*, and cleaning by the drum cleaning units 11*a*, 11*b*, 11*c*, and 11*d*, from an upstream side to a downstream side, are performed on a surface of the photoreceptor drums 2*a*, 2*b*, 2*c*, and 2*d*.

In addition, secondary transfer by the intermediate transfer belt 7, the secondary transfer roller 8 and the opposing roller 18, and fixing by the fixing device 9 are performed in the image forming unit.

Each of the photoreceptor drums 2*a*, 2*b*, 2*c*, and 2*d* is composed of a cylindrically shaped member and functions as a photoreceptor or an image carrier. Each of the photoreceptor drums 2*a*, 2*b*, 2*c*, and 2*d* is disposed so as to be rotatable in a direction of an arrow, about an axis that extends in a direction orthogonal to a direction of movement of the intermediate transfer belt 7. An electrostatic latent image is formed on a surface of each of the photoreceptor drums 2*a*, 2*b*, 2*c*, and 2*d*.

The charging units 10*a*, lob, 10*c*, and 10*d* are disposed so as to face a surface of the photoreceptor drums 2*a*, 2*b*, 2*c*, and 2*d*, respectively. The charging units 10*a*, 10*b*, 10*c*, and 10*d* uniformly negatively charge (negative polarity) or positively charge (positive polarity) the surface of the photoreceptor drums 2*a*, 2*b*, 2*c*, and 2*d*, respectively. The charging units 10*a*, 10*b*, 10*c*, and 10*d* are configured to include charging rollers (not shown) disposed so as to be pressed against and to face a surface of the photoreceptor drums 2*a*, 2*b*, 2*c*, and 2*d* and a cleaning roller (not shown) that cleans the charging rollers in a state of being pressed thereagainst.

The laser scanner units 4*a*, 4*b*, 4*c*, and 4*d* function as exposure units and are disposed to be spaced apart from the surface of the photoreceptor drums 2*a*, 2*b*, 2*c*, and 2*d*, respectively. The laser scanner units 4*a*, 4*b*, 4*c*, and 4*d* are configured to each include a laser light source, a polygonal mirror, a polygonal mirror drive motor and the like, which are not shown.

The laser scanner units 4*a*, 4*b*, 4*c*, and 4*d* scan and expose the surface of the photoreceptor drums 2*a*, 2*b*, 2*c*, and 2*d*, respectively, based on image information regarding the original G read by the reader unit 301. By being scanned and exposed by the laser scanner units 4*a*, 4*b*, 4*c*, and 4*d*, an electric charge generated by charging the surface of the photoreceptor drums 2*a*, 2*b*, 2*c*, and 2*d* is removed, respectively. In this way, an electrostatic latent image is formed on a surface of each of the photoreceptor drums 2*a*, 2*b*, 2*c*, and 2*d*.

The developing units 16*a*, 16*b*, 16*c*, and 16*d* are disposed so as to correspond to the photoreceptor drums 2*a*, 2*b*, 2*c*, and 2*d*, respectively, and so as to face the surface of the photoreceptor drums 2*a*, 2*b*, 2*c*, and 2*d*. The developing units 16*a*, 16*b*, 16*c*, and 16*d* each develop a colored toner image by depositing toner of each color on the electrostatic latent image formed on each of the photoreceptor drums 2*a*, 2*b*, 2*c*, and 2*d* (a toner image is formed on a surface of the photoreceptor drum). The developing units 16*a*, 16*b*, 16*c*, and 16*d* correspond to the four toner colors of yellow, cyan, magenta, and black. The developing units 16*a*, 16*b*, 16*c*, and 16*d* are configured to include developing rollers that can be disposed to face the photoreceptor drums 2*a*, 2*b*, 2*c*, and 2*d*, stirring rollers for stirring toners, and the like.

The toner cartridges 5*a*, 5*b*, 5*c*, and 5*d* are provided correspondingly to the developing units 16*a*, 16*b*, 16*c*, and 16*d*, respectively. In addition, the toner cartridges 5*a*, 5*b*, 5*c*, and 5*d* store toners of the colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner feeding units 6*a*, 6*b*, 6*c*, and 6*d* are provided to correspond to the toner cartridges 5*a*, 5*b*, 5*c*, and 5*d* and the developing units 16*a*, 16*b*, 16*c*, and 16*d*, respectively. The toner feeding units 6*a*, 6*b*, 6*c*, and 6*d* supply the toners of the colors stored in the toner cartridges 5*a*, 5*b*, 5*c*, and 5*d* to the developing units 16*a*, 16*b*, 16*c*, and 16*d*, respectively. Toner delivery pipes for connecting the toner feeding units 6*a*, 6*b*, 6*c*, and 6*d* and the developing units 16*a*, 16*b*, 16*c*, and 16*d*, respectively, are not shown.

Toner images of respective colors developed on the photoreceptor drums 2*a*, 2*b*, 2*c*, and 2*d* are sequentially transferred to the intermediate transfer belt 7. The intermediate transfer belt 7 is stretched around a driven roller 35, an opposing roller 18 consisting of a drive roller, a tension roller 36 and the like. Since the tension roller 36 biases the intermediate transfer belt 7 from the inside to the outside, a predetermined tension is applied to the intermediate transfer belt 7.

The primary transfer rollers 37*a*, 37*b*, 37*c*, and 37*d* are disposed across the intermediate transfer belt 7 from the photoreceptor drums 2*a*, 2*b*, 2*c*, and 2*d* so as to face the photoreceptor drums 2*a*, 2*b*, 2*c*, and 2*d*, respectively.

Predetermined portions of the intermediate transfer belt 7 are sandwiched between the primary transfer rollers 37*a*, 37*b*, 37*c*, and 37*d* and the photoreceptor drums 2*a*, 2*b*, 2*c*, and 2*d*, respectively. The predetermined portions being sandwiched are pressed against surfaces of the photoreceptor drums 2*a*, 2*b*, 2*c*, and 2*d*. Primary transfer nips N1*a*, N1*b*, N1*c*, and N1*d* are formed between the photoreceptor drums 2*a*, 2*b*, 2*c*, and 2*d* and the primary transfer rollers 37*a*, 37*b*, 37*c*, and 37*d*, respectively. On each of the primary transfer nips N1*a*, N1*b*, N1*c*, and N1*d*, the toner images of the colors developed on the photoreceptor drums 2*a*, 2*b*, 2*c*, and 2*d* are sequentially transferred to the intermediate transfer belt 7. A full-color toner image is thus formed on the intermediate transfer belt 7.

A primary transfer bias is applied to each of the primary transfer rollers 37*a*, 37*b*, 37*c*, and 37*d* by a voltage application means (not shown). The primary transfer bias is a bias for transferring the toner images of the colors developed on the photoreceptor drums 2*a*, 2*b*, 2*c*, and 2*d* to the intermediate transfer belt 7, respectively.

The static eliminators 12*a*, 12*b*, 12*c*, and 12*d* are disposed so as to face a surface of the photoreceptor drums 2*a*, 2*b*, 2*c*, and 2*d*, respectively. The static eliminators 12*a*, 12*b*, 12*c*, and 12*d* each remove electricity (eliminate electrical charge) from the surface of the photoreceptor drums 2*a*, 2*b*, 2*c*, and 2*d* after the primary transfer, by irradiating light onto the surface of each of the photoreceptor drums 2*a*, 2*b*, 2*c*, and 2*d*.

The drum cleaning units 11*a*, 11*b*, 11*c*, and 11*d* are disposed so as to face a surface of the photoreceptor drums 2*a*, 2*b*, 2*c*, and 2*d*, respectively. The drum cleaning units 11*a*, 11*b*, 11*c*, and 11*d* remove toner and attached matter remaining on the surface of the photoreceptor drums 2*a*, 2*b*, 2*c*, and 2*d*, respectively, and make the removed toner carried to a predetermined collection mechanism for collection.

The secondary transfer roller 8 secondarily transfers the toner image, which was primarily transferred to the intermediate transfer belt 7, to the paper T. A secondary transfer bias for transferring the toner image formed on the intermediate transfer belt 7 to the paper T is applied to the secondary transfer roller 8, by a voltage application means (not shown).

The secondary transfer roller 8 can be either in contact with or spaced apart from the intermediate transfer belt 7. More specifically, the secondary transfer roller 8 is configured to be movable between a contact position that is in contact with the intermediate transfer belt 7 and a spaced position that is spaced apart from the intermediate transfer belt 7. In particular, the secondary transfer roller 8 is moved to the contact position for transferring the toner image primarily transferred to a surface of the intermediate transfer belt 7 to the paper T, and to the spaced position in other circumstances.

An opposing roller 18 is disposed across the intermediate transfer belt 7 from the secondary transfer roller 8. A part of the intermediate transfer belt 7 is sandwiched between the secondary transfer roller 8 and the opposing roller 18. The paper T is pressed against an outer surface (a side to which the toner image is primarily transferred) of the intermediate transfer belt 7. A secondary transfer nip N2 is formed between the secondary transfer roller 8 and the opposing roller 18. On the secondary transfer nip N2, the toner image primarily transferred to the intermediate transfer belt 7 is secondarily transferred to the paper T.

The fixing unit 9 fuses color toners constituting the toner image secondarily transferred to the paper T, while fixing the color toners on the paper T. The fixing unit 9 includes a heating roller 9*a* that is heated by a heater, and a pressurizing roller 9*b* that is brought into pressure-contact with the heat roller 9*a*. The heating roller 9*a* and the pressurizing roller 9*b* sandwich and convey the paper T to which the toner image is secondarily transferred. The paper T is conveyed in a state of being sandwiched between the heating roller 9*a* and the pressurizing roller 9*b*, thereby fusing and fixing the toner transferred thereto.

Next, the paper feeding/ejection portion is described.

As shown in FIG. 1, two paper feeding cassettes 52 for housing the paper T are disposed one above the other on a lower side of the apparatus main body M. The paper feeding cassettes 52 are configured to be slidable in a horizontal direction from housing of the apparatus main body M. The paper feeding cassettes 52 include a placed board 60 on which the paper T is placed. The paper feeding cassettes 52 store the paper T being stacked on the placed board 60. When forming an image on the paper T, the paper T placed on the placed board 60 is fed to the conveying path L by a cassette feeding portion 51 disposed in an end portion of the paper feeding cassette 52 on a side of feeding the paper (in a left end portion of FIG. 1). The cassette feeding portion 51 includes a double feed preventing mechanism consisting of a forward feed roller 61 for picking up the paper T on the placed board 60, and a paper feeding roller pair 63 for feeding the paper T one sheet at a time to the conveying path L.

The manual feeding portion 64 is provided on a right lateral face (the right side in FIG. 1) of the apparatus main body M. The manual feeding portion 64 is provided primarily for the purpose of feeding paper T that is different in size and type from the paper T stored in the paper feeding cassette 52 to the apparatus rain body M. The manual feeding portion 64 includes the manual feeding tray 65, which constitutes a portion of the apparatus main body M in a closed state, and a paper feeding roller 66. A lower end of the manual feeding tray 65 is connected in the vicinity of the paper feeding roller 66, so as to be pivotable (openable and closable). The paper T is placed on the lower end of the manual feeding tray 65 in an opened state. The manual feeding portion 64 feeds the paper T placed on the manual feeding tray 65 in an opened state to a manual feeding path La.

A first ejection portion 50*a* and a second ejection portion 50*b* are provided on an upper side of the apparatus main body A. The first ejection portion 50*a* and the second ejection portion 50*b* eject the paper T to the outside of the apparatus main body M. The first ejection portion 50*a* and the second ejection portion 50*b* are described later in detail.

The conveying path L includes a third conveying path L3 from the cassette feeding portion 51 to the secondary transfer roller 8, a fourth conveying path L4 from the secondary transfer roller 8 to the fixing unit 9, a fifth conveying path L5 from the fixing unit 9 to a first branch portion Q1 as the branch portion, a first conveying path L1 from the first branch portion Q1 to the first ejection portion 50*a*, a second conveying path L2 from the first branch portion Q1 to the second ejection portion 50*b*, the manual conveying path La that guides paper fed from the manual feeding portion 64 to the third conveying path L3, a reverse conveying path Lb that reverses and returns the paper, that is conveyed from an upstream side to a downstream side in the fifth conveying path L5 to the first conveying path L1, to the third conveying path L3. In an end portion of the reverse conveying path Lb on a side to the first branch portion Q1, a restriction member (not shown) is disposed for restricting the paper T from entering, conveyed in the fifth conveying path L5, into the reverse conveying path Lb.

The first branch portion Q1 is a branch portion that connects the first conveying path L1, the second conveying path L2 and the fifth conveying path L5. The first branch portion Q1 is a branch portion that guides the paper T having been conveyed through the fifth conveying path L5 to the first conveying path L1 or to the second conveying path L2. The paper T having been conveyed by the fifth conveying path L5 to the first branch portion Q1 is prevented from entering to the reverse conveying path Lb by the abovementioned restriction member and is guided to the first conveying path L1 or to the second conveying path L2. The first conveying path L1 guides the paper T to the first ejection portion 50*a*. The second conveying path L2 guides the paper T to the second ejection portion 50*b*.

A switching member 58 is provided in the first branch portion Q1. The switching member 58 selectively switches a conveying direction of the paper T discharged from the fixing unit 9 and guided by the fifth conveying path L5 to the first conveying path L1 leading to the first ejection portion 50*a* or to the second conveying path L2 leading to the second ejection portion 50*b*.

The switching member 58 is moved by a drive unit 59 (see FIGS. 2 and 3), which is described later. The switching member 58 and the drive unit 59 are described later in detail.

In addition, a first junction Pl and a second junction P2 are provided in the middle of the third conveying path L3.

The first junction P1 is a junction where the manual conveying path La joins the third conveying path L3. The second junction P2 is a junction where the reverse conveying path Lb joins the third conveying path L3.

In addition, a sensor for detecting the paper T and a resist roller pair 80 for skew compensation of the paper T and timing adjustment with respect to the toner image are disposed in the middle of the third conveying path L3 (more specifically, between the second junction P2 and the secondary transfer roller 8). The sensor is disposed immediately before the resist roller pair 80 in a conveying direction of the paper T (on an upstream side thereof). The resist roller pair 80 conveys the paper T while performing the abovementioned compensation and the timing adjustment based on detection information from the sensor.

When performing duplex printing of the paper T, the reverse conveying path Lb, which is a conveying path for forming an image on an opposite surface (an unprinted surface) to a surface that has already been printed, is set to be the conveying path. The reverse conveying path Lb can reverse and return the paper T, conveyed from the first branch portion Q1 toward the first ejection portion 50*a*, to the third conveying path L3, in order to convey the paper T to an upstream side of the resist roller pair 80 disposed on an upstream side of the secondary transfer roller 8. A toner image is transferred by the secondary transfer roller 8 to an unprinted surface of the paper T, which has been reversed by the reverse conveying path Lb.

The first ejection portion 50*a* is formed in an end portion of the first conveying path Li. The first ejection portion 50*a* is disposed on an upper side of the apparatus main body M. The first ejection portion 50*a* has an opening toward a right lateral face of the apparatus main body M (right side in FIG. 1 and on a side of the manual feeding portion 64). The first ejection portion 50*a* guides the paper T in a state where a conveying direction is switched toward the first conveying path L1 by the switching member 58 and ejects the paper T to the outside of the apparatus main body M.

An ejected paper accumulating portion M1 is formed on a side to the opening of the first ejection portion 50*a*. The ejected paper accumulating portion M1 is formed on an upper face (outer face) of the apparatus main body M. The ejected paper accumulating portion M1 is a portion of the upper face of the apparatus main body M formed to be depressed downward. A bottom face of the ejected paper accumulating portion M1 constitutes a part of the upper face of the apparatus main body M. The paper T, to which a predetermined toner image is formed, ejected from the first ejection portion 50*a* is accumulated in the ejected paper accumulating portion M1.

The second ejection portion 50*b* is formed in an end portion of the second conveying path L2. The second ejection portion 50*b* is disposed on the upper side of the apparatus main body M. The second ejection portion 50*b* has an opening toward a left lateral face of the apparatus main body M (left side in FIG. 1 and on a side to which the post-processing apparatus is connected). The second ejection portion 50*b* guides the paper T in a state where a conveying direction is switched toward the second conveying path L2 by the switching member 58 and ejects the paper T to the outside of the apparatus main body M.

A post-processing apparatus (not shown) can be connected to a side of the opening of the second ejection portion 50*b*. The post-processing apparatus performs post processing (stapling, punching and the like) of the paper ejected from the image forming apparatus (copy machine 1).

It should be noted that a sensor for detecting paper is disposed at a predetermined position on each conveying path.

Next, a structure for eliminating paper jams in main conveying paths L1 and L3 to L5 (the first conveying path L1, the third conveying path L3, the fourth conveying path L4 and the fifth conveying path L5 are also collectively referred to as "main conveying paths" hereinafter) and in the reverse conveying path Lb is briefly described.

As shown in FIG. 1, on a left lateral face side of the apparatus main body M (left side in FIG. 1), the main conveying paths L1 and L3 to L5 and the reverse conveying path Lb are disposed in parallel so as to extend mainly in a vertical direction. On a left lateral face side of the apparatus main body M (left side in FIG. 1), a cover body 40 is provided so as to form a portion of the lateral face of the apparatus main body M. A lower end portion of the cover body 40 is connected with the apparatus main body M via a fulcrum shaft 43. The fulcrum shaft 43 is disposed so that an axial direction thereof is along a direction intersecting the main conveying paths L1 and L3 to L5 and the reverse conveying path Lb. The cover body 40 is configured to be pivotable about the fulcrum shaft 43 between a closed position (shown in FIG. 1) and an opened position (not shown).

The cover body 40 is composed of a first cover portion 41 that is connected with the apparatus main body M to be pivotable by the fulcrum shaft 43 and a second cover portion 42 that is connected with the apparatus main body M to be pivotable by the same fulcrum shaft 43. The first cover portion 41 is positioned more to an external side (lateral face side) of the apparatus main body M than the second cover portion 42. It should be noted that, in FIG. 1, the first cover portion 41 is a part hatched with diagonal broken lines from top right to bottom left, and the second cover portion 42 is a part hatched with diagonal broken lines from top left to bottom right.

In a state where the cover body 40 is in a closed position, an outer face side of the first cover portion 41 constitutes a portion of an outer face (lateral face) of the apparatus main body M.

In addition, in a state where the cover body 40 is in the closed position, an inner face side (a side to the apparatus main body M) of the second cover portion 42 constitutes a portion of the main conveying paths L1 and L3 to L5.

Furthermore, in a state where the cover body 40 is in the closed position, an inner face side of the first cover portion 41 and an outer face side of the second cover portion 42 constitute at least a portion of the reverse conveying path Lb. In other words, the reverse conveying path Lb is formed between the first cover portion 41 and the second cover portion 42.

Since the copy machine 1 according to the present embodiment is provided with the cover body 40 thus configured, in a case where a paper jam occurs in the main conveying paths L1 and L3 to L5, jammed paper in the main conveying paths L1 and L3 to L5 can be removed by opening the main conveying paths L1 and L3 to L5 by pivoting the cover body 40 from the closed position shown in FIG. 1 to the opened position (not shown). On the other hand, in a case where a paper jam occurs in the reverse conveying path Lb, jammed paper in the reverse conveying path Lb can be removed by opening the reverse conveying path Lb by pivoting the cover body 40 to the opened position, and then pivoting the second cover portion 42 about the fulcrum shaft 43 toward the apparatus main body M (right side in FIG. 1).

Figure 2:
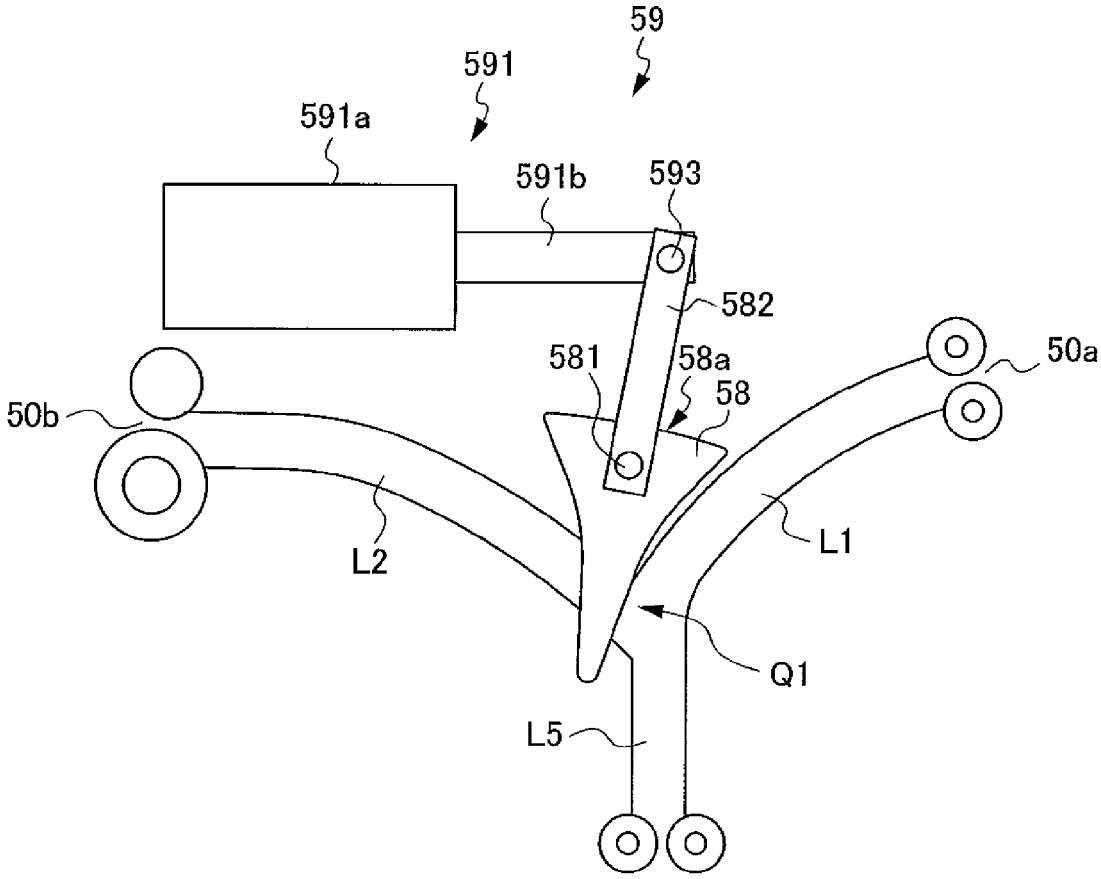
FIG. 2 is a diagram illustrating a state of a switching member 58 being placed at a first position 58*a;*
Figure 3:
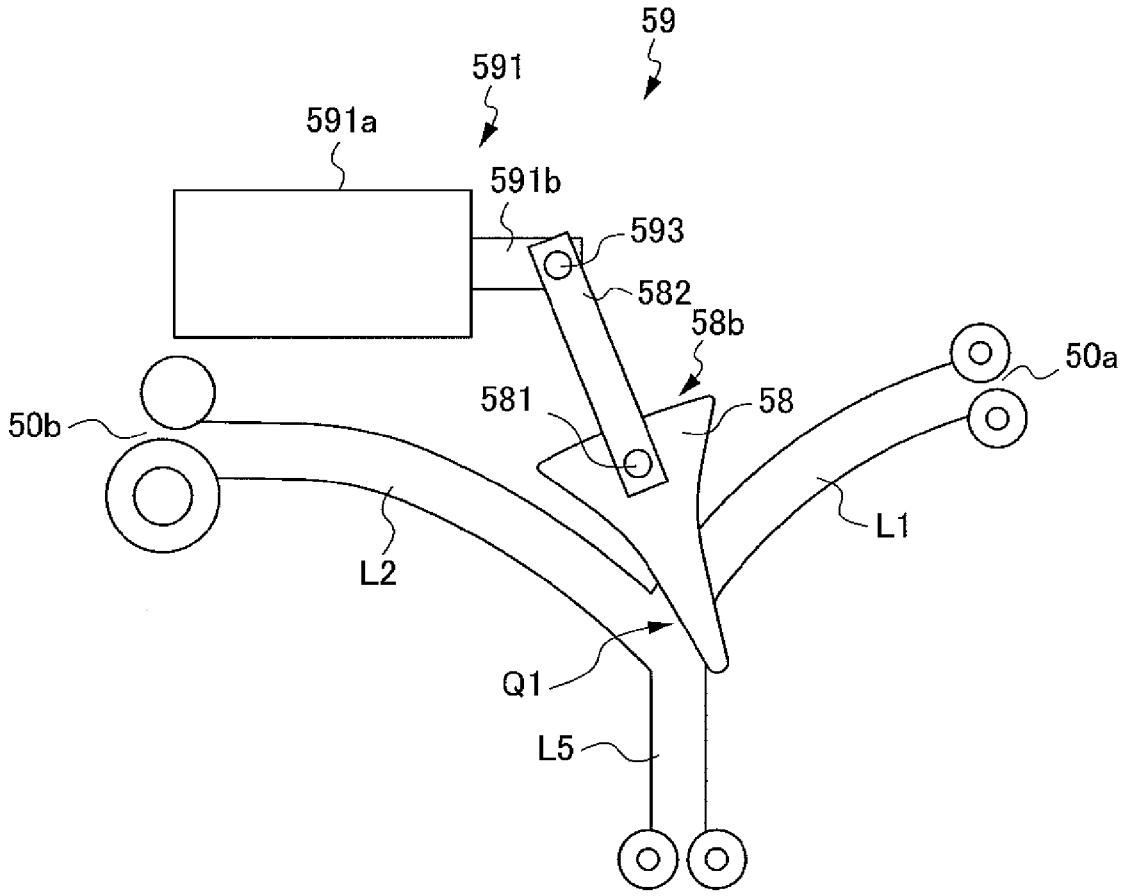
FIG. 3 is a diagram illustrating a state of a switching member 58 being placed at a second position 58*b;*

Next, a configuration of the copy machine 1 according to the present embodiment is mainly described in detail hereinafter with reference to FIGS. 2 and 3, focusing on the switching member 58 and the drive unit 59. FIG. 2 is a diagram illustrating a state in which a switching member 58 is placed at a first position 58*a*. FIG. 3 is a diagram illustrating a state in which a switching member 58 is placed at a second position 58*b*.

As shown in FIGS. 2 and 3, the switching member 58 is disposed in the first branch portion Q1.

The switching member 58 is configured to be movable between a first position 58*a* (see FIG. 2) that directs the paper T being guided and conveyed by the fifth conveying path L5 toward the first conveying path L1, and a second position 58*b* (see FIG. 3) that directs the paper T being guided and conveyed by the fifth conveying path L5 toward the second conveying path L2.

The switching member 58 is configured to include a plurality of plate members that have a substantially isosceles triangle shape with concavely curved opposing sides. The plate members of the switching member 58 are disposed at predetermined intervals in a direction (a direction vertical to a paper surface in FIGS. 2 and 3) that is orthogonal to the conveying direction of the paper T. The plurality of switching members 58 is pivotally supported by a spindle 581. The spindle 581 pivotally supports the switching members 58 on a bottom side of the switching members 58 and disposed along the direction that is orthogonal to the conveying direction of the paper T.

The switching members 58 are configured to be rotatable in accordance with rotation of the spindle 581 that pivotally supports the switching members 58. The switching members 58 are configured to be movable between the first position 58*a* (see FIG. 2) and the second position 58*b* by rotation of the spindle 581. The first position 58*a* is a position where an apex of the switching member 58 is moved toward the second conveying path L2 in order to prevent the paper T from entering the second conveying path L2. The second position 58*b* is a position where an apex of the switching member 58 is moved toward the first conveying path L1 in order to prevent the paper T from entering the first conveying path L1.

More specifically, in a case where the switching member 58 is in the first position 58*a*, the apex of the switching member 58 is not positioned in the first conveying path L1, as shown in FIG. 2. The apex of the switching member 58 is disposed so as to block the second conveying path L2, thereby preventing the paper T from entering to the second conveying path L2. In other words, the switching member 58 in the first position 58*a* prevents the paper T from the fifth conveying path L5 from entering the second conveying path L2, but allows the paper T from the fifth conveying path L5 to be fed toward the first conveying path L1.

In a case where the switching member 58 is in the second position 58*b*, the apex of the switching member 58 is not positioned in the second conveying path L2, as shown in FIG. 3. The apex of the switching member 58 is disposed so as to block the first conveying path L1, thereby preventing the paper T from entering the first conveying path Ll. In other words, the switching member 58 in the second position 58*b* prevents the paper T from the fifth conveying path L5 from entering to the first conveying path L1, but allows the paper T from the fifth conveying path L5 to be fed toward the second conveying path L2.

The switching members 58 are configured to be movable from the first position 58*a* to the second position 58*b* or vice versa, by the drive unit 59.

The drive unit 59 is provided with, an arm unit 582 that is fixed on an end portion of the spindle 581 of the switching member 58, and a solenoid 591 that generates a driving force and transmits the driving force to the arm unit 582.

A first end of the arm unit 582 is fixed on an end portion of the spindle 581 of the switching member 58. The arm unit 582 is formed so as to extend from a bottom side to the outer side, in a direction from the apex to the bottom of the switching member 58. The arm unit 582 connects the switching member 58 with the solenoid 591.

The solenoid 591 is configured to include a solenoid main body 591*a* that includes a solenoid coil (not shown) and an output shaft portion 591*b* that outputs and transmits a driving force from the solenoid main body 591*a* to the arm unit 582. The other end of the arm unit 582 is rotatably connected to an apex of the output shaft portion 591*b* via a connection pin 593. The output shaft portion 591*b* is supported by the solenoid main body 591*a* such that the output shaft portion 591*b* can advance and retract. The output shaft portion 591*b* is biased toward a direction of advancement (projection) of the output shaft portion 591*b* by a biasing member (not shown).

The output shaft portion 591*b* is configured to move toward a direction of retraction (draw in) of the output shaft portion 591*b* upon energization of the solenoid coil not having been energized. The output shaft portion 591*b* is configured to move toward a direction of advancement (projection) with bias of the biasing member, when the solenoid coil is not energized.

At least one of the switching member 58 and the drive unit 59 generates a first switching sound when the switching member 58 is moved from the first position 58*a* to the second position 58*b*. At least one of the switching member 58 and the drive unit 59 generates a second switching sound when the switching member 58 is moved from the second position 58*b* to the first position 58*a*.

In the present embodiment, the solenoid 591 constituting the drive unit 59 may generate, upon transition from a non-energized state to an energized state (movement in the direction of retraction of the output shaft portion 591*b*), an operation sound that is louder than an operation sound generated upon transition from the energized state to the non-energized state (movement in the direction of advancement of the output shaft portion 591*b*). In addition, the switching member 58 may generate a contact sound due to contact with peripheral members upon switching of the switching member 58.

In such a case, the first switching sound and the second switching sound are all sounds generated upon switching, such as the operation sound of the drive unit 59 and the contact sound between the switching member 58 and the peripheral members.

For example, in the present embodiment, the first switching sound generated upon switching from the first position 58*a* to the second position 58*b* tends to be louder than the second switching sound generated upon switching from the second position 58*b* to the first position 58*a*, due to characteristics of the solenoid 591.

Figure 4:
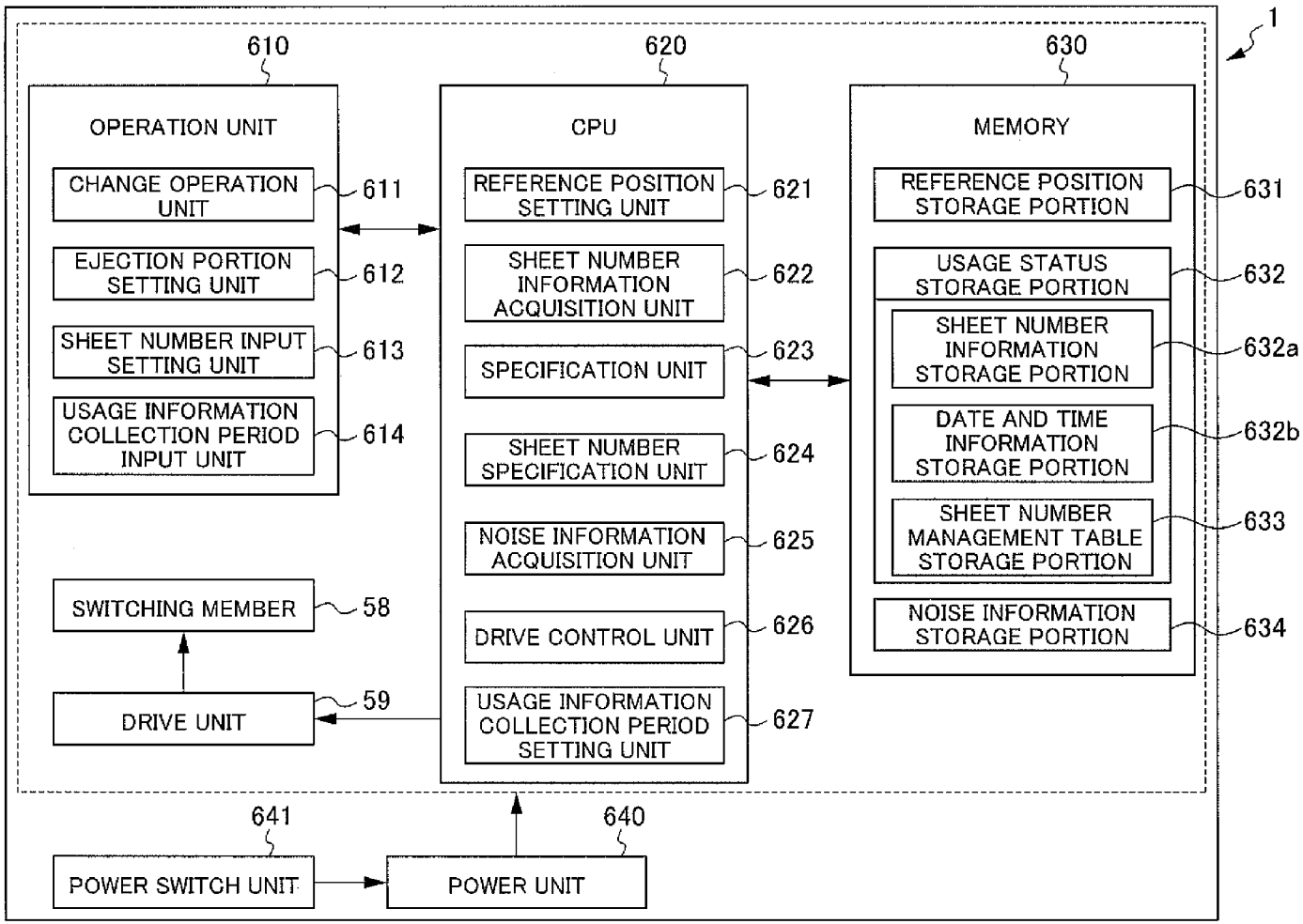
FIG. 4 is a functional block diagram of the present embodiment.

Next, a functional block diagram of the present embodiment is described with reference to FIG. 4. FIG. 4 is a functional block diagram of the present embodiment. FIG. 5 is a diagram illustrating a number management table storage portion 633 in a usage status storage portion 632 shown in FIG. 4.

As shown in FIG. 4, the copy machine 1 includes, a power switch unit 641, a power unit 640, an operation unit 610, a CPU 620, memory 630, the abovementioned switching member 58, and the abovementioned drive unit 59.

The power switch unit 641 instructs the power unit 640 to power-on and power-off.

The power unit 640 supplies electricity to the copy machine 1. The power unit 640 is switched between a power-on state and a power-off state by an operation of the power switch unit 641. The copy machine 1 is in an initial state when switched from the power-off state to the power-on state by a power-on operation of the power unit 640 by the power switch unit 641. Here, the power-off state of the copy machine 1 includes a sleep state. The power-on operation of the power unit 640 includes a power-on operation of the power unit from the sleep state. The power-off operation of the copy machine 1, from the power-on state to the power-off state, includes an auto power-off that makes the copy machine automatically go into the power-off state after a predetermined period of time. Auto power-off includes a power-off operation that makes the copy machine go into the sleep state.

The operation unit 610 includes a change operation unit 611, an ejection portion setting unit 612, a number input setting unit 613, and a usage information collection period input unit 614. The operation unit 610 is configured to include an operation key group and an operation panel (not shown). The operation unit 610 is configured to be operable from the outside of the copy machine 1 via the operation key group and the operation panel.

The change operation unit 611 can output a signal to and instruct a reference position setting unit 621 (described later) to change the reference position. More specifically, the change operation unit 611 is operated in order to set the reference position of the switching member 58 to the first position 58*a*. In this case, a signal output from the change operation unit 611 being operated is received by a reference position setting unit 621. Then, the reference position setting unit 621 outputs a signal and updates reference position information stored in a reference position storage portion 631.

The ejection portion setting unit 612 can output a signal to a specification unit 623 (described later) and instruct change of position of the switching member 58. More specifically, the ejection portion setting unit 612 can select a position of the switching member 58 from the first position 58*a* and the second position 58*b*, thereby setting from which of the first ejection portion 50*a* and the second ejection portion 50*b* the paper T is ejected.

The number input setting unit 613 can output a signal to a number specification unit 624 (described later) and instruct a number of sheets of the paper T onto which an image is to be transferred by the image forming unit. More specifically, the number input setting unit 613 is configured to allow input and setting of a number of sheets of the paper T onto which an image is to be transferred by the image forming unit, at the switching member 58 positioned at the first position 58*a* or the second position 58*b* set by the ejection portion setting unit 612.

The usage information collection period input unit 614 can output a signal to a usage information collection period setting unit 627 (described later) and instruct setting of a collection period, which is a predetermined period for collecting the usage information including information regarding the position of the switching member 58. More specifically, the usage information collection period input unit 614 is configured to allow input of a collection period for collecting usage information.

The CPU 620 controls the copy machine 1 as a whole. The CPU 620 includes, particularly, the reference position setting unit 621 as a function unit, a number information acquisition unit 622, the specification unit 623, a number specification unit 624, a noise information acquisition unit 625, a drive control unit 626, and the usage information collection period setting unit 627.

The reference position setting unit 621 sets the reference position of the switching member 58 in the initial state of the copy machine 1 (when the copy machine 1 is switched from the power-off state to the power-on state by the power-on operation of the power unit 640). The reference position setting unit 621 sets the reference position of the switching member 58 based on a setting operation of the reference position by the change operation unit 611. In addition, the reference position setting unit 621 sets the reference position of the switching member 58 based on information stored in a usage status storage portion 632 (described later) and information stored in a noise information storage portion 634 (described later).

Then, the reference position setting unit 621 changes the reference position information stored in the reference position storage portion 631 based on a signal output from the change operation unit 611. More specifically, the reference position setting unit 621 can change the reference position from the first position 58*a* to the second position 58*b*, in a case where the first position 58*a* is stored in the reference position storage portion 631 as the reference position in the reference position information.

Then, the reference position setting unit 621 changes the reference position information stored in the reference position storage portion 631 in response to a signal output from the change operation unit 611. More specifically, the reference position setting unit 621 obtains usage information from the usage status storage portion 632. The reference position setting unit 621 sets the reference position of the switching member 58 based on the usage status thus obtained.

More particularly, the reference position setting unit 621 refers to a table stored in a number management table storage portion 633 (described later, see FIG. 5) in the usage status storage portion 632, for example, once a week. The reference position setting unit 621 sets the reference position of the switching member 58 based on a result of referencing the table stored in the number management table storage portion 633. The reference position storage portion 631, with a setting of the reference position setting unit 621, changes (or maintains) the reference position information stored in a reference position storage portion 631 in response to the signal output from the reference position setting unit 621.

In this case, the reference position setting unit 621 can set the reference position of the switching member 58 to the first position 58*a* in a case where usage frequency of the second ejection portion 50*b* in a week is less than 70% of that of entire ejection portion. The reference position setting unit 621 can set the reference position of the switching member 58 to the second position 58*b* in a case where the usage frequency of the second ejection portion 50*b* in a week is no less than 70% of that of the entire ejection portion.

The reference position setting unit 621 obtains noise information stored in the noise information storage portion 634.

The reference position setting unit 621 compares first noise information regarding loudness of the first switching sound with second noise information regarding loudness of the second switching sound stored in the noise information storage portion 634, and determines which of the two is louder.

In addition, the reference position setting unit 621 sets the first position 58*a* as the reference position in a case where the first switching sound is louder than the second switching sound. On the other hand, the reference position setting unit 621 sets the second position 58*b* as the reference position in a case where the second switching sound is louder than the first switching sound. With setting of the reference position setting unit 621, the reference position storage portion 631 changes (or maintains) the reference position information stored in a reference position storage portion 631 in response to the signal output from the reference position setting unit 621.

In other words, the reference position setting unit 621 allows a switching operation that generates a loud switching sound to be performed in a state where the switching sound would be masked by noise generated upon beginning the image forming operation. In addition, the reference position setting unit 621 sets the reference position so as to allow a switching operation that generates a quiet switching sound to be performed in a state where the switching sound would not be masked (the switching sound is outstanding as noise) as the image forming operation is terminated, and thus noise is not generated.

The number information acquisition unit 622 obtains number information relating to a number of sheets of the paper T ejected from the first ejection portion 50*a* and a number of sheets of the paper T ejected from the second ejection portion 50*b* by a counter (not shown). The number information relating to the paper T obtained by the number information acquisition unit 622 is stored in the number information storage portion 632*a* in the usage status storage portion 623 (described later).

The specification unit 623 can specify the position of the switching member 58 in response to a signal output from the ejection portion setting unit 612. The ejection portion setting unit 612 can specify a position of the switching member 58 by the specification unit 623, thereby setting from which of the first ejection portion 50*a* and the second ejection portion 50*b* the paper T is ejected. The specification unit 623 outputs a signal to the drive control unit 626 (described later).

The number specification unit 624 specifies, in response to the signal output from the number input setting unit 613, a number of sheets of the paper T onto which an image is to be transferred by the image forming unit, in a state where the switching member 58 is positioned at the position set by the specification unit 623.

Concretely speaking, the number specification unit 624 specifies the number of sheets of the paper T ejected from the first ejection portion 50*a* or the number of sheets of the paper T ejected from the second ejection portion 50*b*. The number specification unit 624 outputs a signal to the drive control unit 626 (described later).

The image information acquisition unit 625 obtains noise information relating to the first switching sound generated when the switching member 58 is moved from the first position 58*a* to the second position 58*b*, and the second switching sound generated when the switching member 58 is moved from the second position 58*b* to the first position 58*a*.

The noise information acquisition unit 625 obtains the first noise information regarding loudness of the first switching sound and the second noise information regarding loudness of the second switching sound, as noise information as a result of measurement by a noise sensor (not shown). The noise information relating to the first noise information and the second noise information obtained by the noise information acquisition unit 625 are stored in the noise information storage portion 634 (described later).

The drive control unit 626 controls the drive unit 59 such that the switching member 58 is positioned at the reference position in the initial state of the copy machine 1 (when the copy machine 1 is switched from the power-off state to the power-on state by the power-on operation of the power unit 640), based on the reference position information stored in the reference position storage portion 631 (described later). The drive unit 59 moves the switching member 58 to the reference position, controlled by the drive control unit 626.

In a case where the reference position information stored in the reference position storage portion 631 is changed by a setting by the reference position setting unit 621, the drive control unit 626 controls the drive unit 59 such that the switching member 58 is positioned at the reference position, based on the reference position information thus changed. The drive unit 59 moves the switching member 58 to the reference position, controlled by the drive control unit 626.

The drive control unit 626 controls the drive unit 59 based on a specification by the specification unit 623, such that the switching member 58 is positioned at a position thus specified. The drive unit 59 moves the switching member 58 to the position thus referenced, controlled by the drive control unit 626.

In addition, the drive control unit 626 controls the drive unit 59 based on a specification of the number of sheets of the paper T by the number specification unit 624.

The drive control unit 626 controls the drive unit 59 to maintain the switching member 58 at the position specified by the specification unit 623 until the number of sheets of the paper T specified by the number specification unit 624 is carried into the first conveying path L1 or the second conveying path L2.

In particular, in a case where the reference position of the switching member 58 is different from the position specified by the specification unit 623, the drive control unit 626 controls the drive unit 59 such that the switching member 58 does not return to the reference position until the number of sheets of the paper T specified by the number specification unit 624 is ejected from the specified ejection portion. In a case where the number of sheets of the paper T specified by the number specification unit 624 has been ejected from the ejection portion, the drive control unit 626 controls the drive unit 59 to put the switching member 58 back to the reference position.

The usage information collection period setting unit 627 can set a collection period for collecting the usage information including information regarding the position of the switching member 58, in response to the signal output from the usage information collection period input unit 614. The usage information collection period setting unit 627 makes the usage information, in the collection period set by the usage information collection period setting unit 627, stored in the usage status storage portion 632.

In addition, the usage information collection period setting unit 627 shortens or prolongs the collection period in a case where the usage frequency of the first ejection portion 50*a* or the second ejection portion 50*b* in the collection period is within a predetermined range.

The memory 630 stores predetermined data. More specifically, the memory 630 includes, the reference position storage portion 631 that stores the reference position of the switching member 58 in the reference position setting unit 621, the usage status storage portion 632 that stores the usage information and the like relating to the position of the switching member 58, and the noise information storage portion 634.

The reference position storage portion 631 stores reference position information before shipment of the copy machine 1. Before shipment, the reference position storage portion 631 can arbitrarily store either the first position 58*a* or the second position 58*b*, as the reference position of the switching member 58 in the reference position information. More specifically, before shipment of the copy machine 1, the reference position storage portion 631 can store the first position 58*a* as the reference position in a case where the first switching sound is louder than the second switching sound. On the other hand, the reference position storage portion 631 can store the second position 58*b* as the reference position in a case where the second switching sound is louder than the first switching sound.

In the state in which the copy machine 1 is shipped, the drive control unit 626 controls the drive unit 59 by obtaining the reference position information stored in the reference position storage portion 631, in the initial state of the copy machine 1 (when the copy machine 1 is switched from the power-off state to the power-on state by the power-on operation of the power unit 640). The drive unit 59 thus moves the switching member 58 (or maintains the position of the switching member 58).

The reference position information stored in the reference position storage portion 631 is changed by a setting of the reference position setting unit 621 by an operation of the change operation unit 611. The reference position storage portion 631 stores the reference position of the switching member 58 set by the reference position setting unit 621, as the reference position information, in response to the signal output from the reference position setting unit 621.

After that the reference position information in the reference position storage portion 631 is changed by the reference position setting unit 621, the drive control unit 626 controls the drive unit 59 by obtaining the reference position information stored in the reference position storage portion 631, in the initial state of the copy machine 1 (when the copy machine 1 is switched from the power-off state to the power-on state by the power-on operation of the power unit 640). The drive unit 59 thus moves the switching member 58 (or maintains the position of the switching member 58).

The reference position information stored in the reference position storage portion 631 can be changed based on information stored in the usage status storage portion 632 (described later). The reference position storage portion 631 stores the reference position of the switching member 58 set by the reference position setting unit 621, as the reference position information, in response to the signal output from the reference position setting unit 621 based on the information stored in the usage status storage portion 632.

The reference position information stored in the reference position storage portion 631 can be changed based on noise information stored in the noise information storage portion 634 (described later). The reference position storage portion 631 stores the reference position of the switching member 58 set by the reference position setting unit 621, as the reference position information, in response to the signal output from the reference position setting unit 621 based on the noise information stored in the noise information storage portion 634.

The reference position information stored in the reference position storage portion 631 is automatically updated by setting of the reference position setting unit 621 to change the reference position of the switching member 58. The reference position information stored in a reference position storage portion 631 is maintained regardless of the power-on operation and the power-off operation of the power unit 640.

The usage status storage portion 632 includes, the number information storage portion 632*a*, a date and time information storage portion 632*b*, information relating to the position of the switching member 58, and the number management table storage portion 633.

The number information storage portion 632*a* stores number information obtained by the number information acquisition unit 622. The date and time information storage portion 632*b* stores the date and time of ejecting the paper T. The information regarding the position of the switching member 58 is stored in the usage status storage portion 632.

The number management table storage portion 633 correlates and stores information stored in the date and time information storage portion 632*b* and in the number information storage portion 632*a*.

More specifically, the number management table storage portion 633 correlates and stores information relating to the number of the paper T ejected from the first ejection portion 50*a* and the number of the paper T ejected from the second ejection portion 50*b* in a collection period set by the usage information collection period setting unit 627. The number management table storage portion 633 correlates and stores the date and time information, the ejection portion that is used, and the number of sheets of the paper that is ejected.

The noise information storage portion 634 stores the first noise information regarding loudness of the first switching sound and the second noise information regarding loudness of the second switching sound obtained by the noise information acquisition unit 625. The reference position setting unit 621 sets the reference position of the switching member 58 based on the noise information stored in the noise information storage portion 634. More specifically, the reference position setting unit 621 sets the first position 58*a* as the reference position in a case where the first switching sound is louder than the second switching sound. On the other hand, the reference position setting unit 621 sets the second position 58*b* as the reference position in a case where the second switching sound is louder than the first switching sound.

The reference position information set by the reference position setting unit 621 is stored in the reference position storage portion 631.

Figure 6:
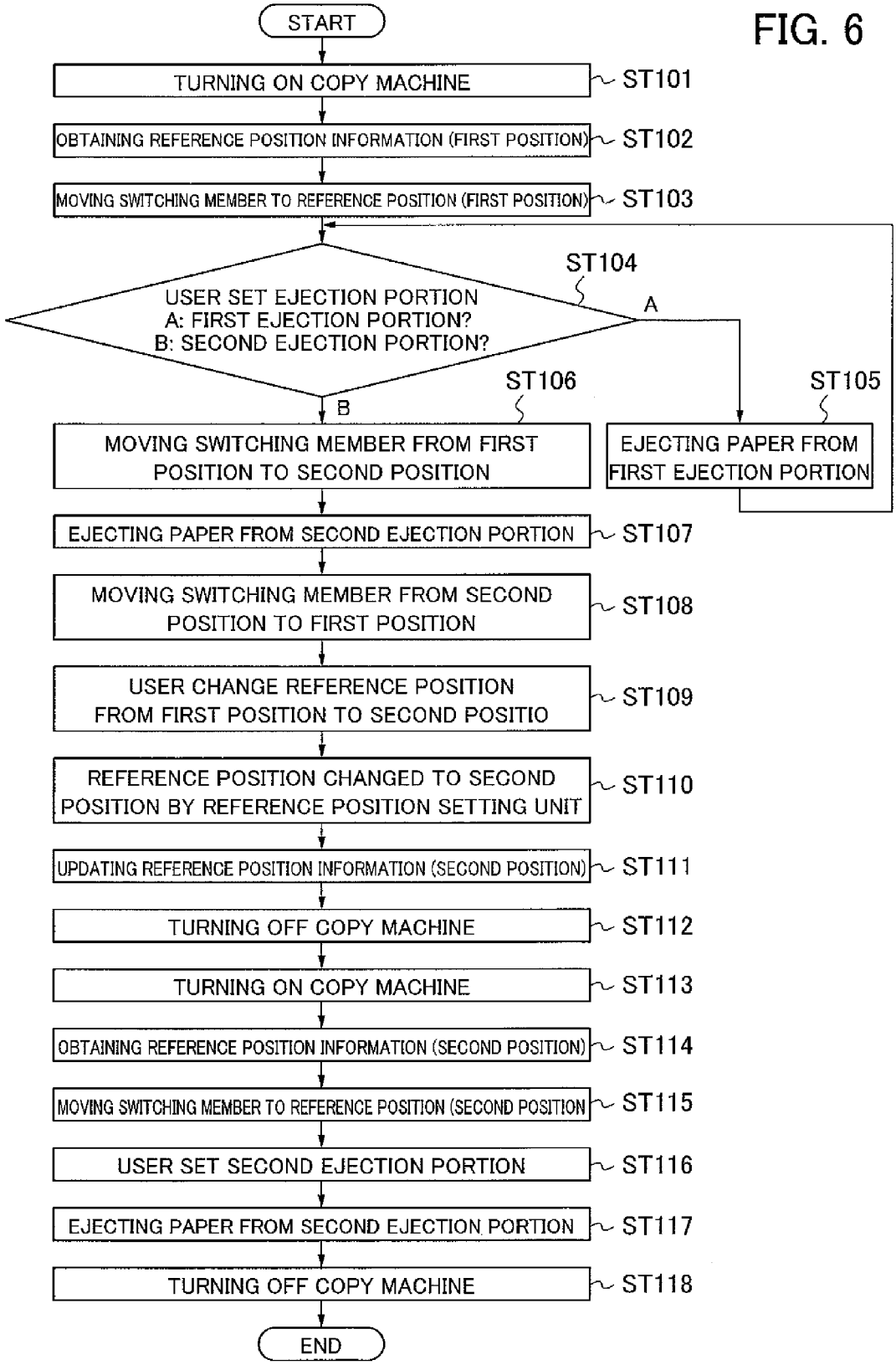
FIG. 6 is a flow chart illustrating operation of a copy machine 1 according to a first embodiment in an initial state.

Next, operation of the copy machine 1 according to the first embodiment is described with reference to FIG. 6. FIG. 6 is a flow chart illustrating operation of a copy machine 1 according to the first embodiment in an initial state.

As shown in FIG. 6, a user first performs the power-on operation of the power unit 640 via the power switch unit 641. The copy machine 1 is thus switched from the power-off state to the power-on state (ST101).

The copy machine 1 according to the present embodiment is configured such that the reference position of the switching member 58 is "the first position 58*a*". The reference position information representing the reference position being the first position 58*a* is stored in the reference position storage portion 631.

It should be noted that, during shipment of the copy machine 1, the reference position storage portion 631 can store the first position 58*a* as the reference position stored in the reference position storage portion 631 in a case where the first switching sound is louder than the second switching sound, or the second position 58*a* as the reference position stored in the reference position storage portion 631 in a case where the second switching sound is louder than the first switching sound.

In the present embodiment, the first position 58*a* is stored in the reference position storage portion 631 as the reference position in the reference position information. The drive control unit 626 obtains the reference position information stored in the reference position storage portion 631 when the copy machine 1 is switched from the power-off state to the power-on state (ST102).

The drive control unit 626 controls the drive unit 59 based on the reference position information obtained from the reference position storage portion 631. The drive unit 59 moves (maintains) the switching member 58 to (at) the first position 58*a* based on an instruction from the drive control unit 626 (ST103).

More specifically, in a case where the switching member 58 is in the second position 58*b* in a state where the copy machine 1 is in the power-off state, the drive unit 59 moves the switching member 58 to the first position 58*a*. On the other hand, in a case where the switching member 58 is in the first position 58*a* in a state where the copy machine 1 is in the power-off state, the drive unit 59 maintains the switching member 58 at the first position 58*a*.

Next, the user selects an ejection portion (the first ejection portion 50*a* or the second ejection portion 50*b*) from which the paper T is ejected, via the ejection portion setting unit 612 in the operation unit 610 (ST104). The ejection portion setting unit 612 instructs the specification unit 623 of the position of the switching member 58.

Here, in a case where the user has selected and set the first ejection portion 50*a* as the ejection portion for the paper T (T104, A), the specification unit 623 instructs the drive control unit 626 to place the switching member 58 at the first position 58*a*. Since the reference position of the switching member 58 is the first position 58*a*, the drive control unit 626 controls the drive unit 59 to maintain the switching member 58 at the first position 58*a*.

The paper T is carried and guided into the first conveying path 1,1 by the switching member 58, which is maintained at the first position 58*a*. Then, the paper T is ejected from the first ejection portion 50*a* (ST105).

On the other hand, in a case where the user has selected and set the second ejection portion 50*b* as the ejection portion for the paper T (T104, B), the specification unit 623 instructs the drive control unit 626 to place the switching member 58 at the second position 58*b*. The drive control unit 626 controls the drive unit 59 to move the switching member 58 to the second position 58*b*.

The drive unit 59 moves the switching member 58 from the first position 58*a* to the second position 58*b* (ST106). At least one of the switching member 58 and/or the drive unit 59 generates the first switching sound accompanying the movement of the switching member 58 from the first position 58*a* to the second position 58*b*.

The paper T is carried and guided into the second conveying path L2 in a state where the switching member 58 is positioned at the second position 58*b*. Then, the paper T is ejected from the second ejection portion 50*b* (ST107).

After ejection of the paper T from the second ejection portion 50*b*, the switching member 58 is moved by the drive unit 59 from the second position 58*b* to the first position 58*a*, which is the reference position. At least one of the switching member 58 and the drive unit 59 generates the second switching sound accompanying the movement of the switching member 58 from the second position 58*b* to the first position 58*a* by the drive unit 59.

Here, the user performs an operation of changing the reference position of the switching member 58 by the change operation unit 611 from the first position 58*a* to the second position 58*b*, in order to suppress generation of the first switching sound and the second switching sound upon ejection of the paper T by the user mainly from the second ejection portion 50*b* (ST109).

In response to a signal output from the change operation unit 611, the reference position setting unit 621 changes the reference position of the switching member 58 from the first position 58*a* to the second position 58*b*, and outputs a signal to the reference position storage portion 631 (ST110).

The reference position storage portion 631 stores the second position 58*b* as the reference position after change, based on the signal output from the reference position setting unit 621. The reference position stored in the reference position storage portion 631 is thus changed from the first position 58*a* to the second position 58*b* (ST111).

Thereafter, the copy machine 1 is turned off either by an operation of the power switch unit 641 or by auto power-off (ST112).

In order to continue using the copy machine 1, the user turns on the copy machine 1 (ST113).

In such a state, the second position 58*b* is stored in the reference position storage portion 631 as the reference position in the reference position information. The drive control unit 626 obtains the reference position information stored in the reference position storage portion 631 when the copy machine 1 is switched from the power-off state to the power-on state (ST114).

The drive control unit 626 controls the drive unit 59 based on the reference position information obtained from the reference position storage portion 631. The drive unit 59 maintains the switching member 58 at the second position 58*b* based on an instruction from the drive control unit 626 (ST115).

Next, in a case where the user has selected and set the second ejection portion 50*b* as the ejection portion for the paper T (T116), the specification unit 623 instructs the drive control unit 626 to move the switching member 58 to the second position 58*b*. Since the reference position of the switching member 58 is the second position 58*b*, the drive control unit 626 controls the drive unit 59 to maintain the switching member 58 at the second position 58*b*.

The paper T is carried and guided into the second conveying path L2 by the switching member 58, which is maintained at the second position 58*b*. Then, the paper T is ejected from the second ejection portion 50*b* (ST117). The switching member 58 and/or the drive unit 59 does not generate a switching sound since the switching member 58 is not moved by the drive unit 59. The copy machine 1 quietly ejects the paper to the outside.

Thereafter, the copy machine 1 is turned off either by an operation of the power switch unit 641 or by auto power-off (ST118).

Figure 7:
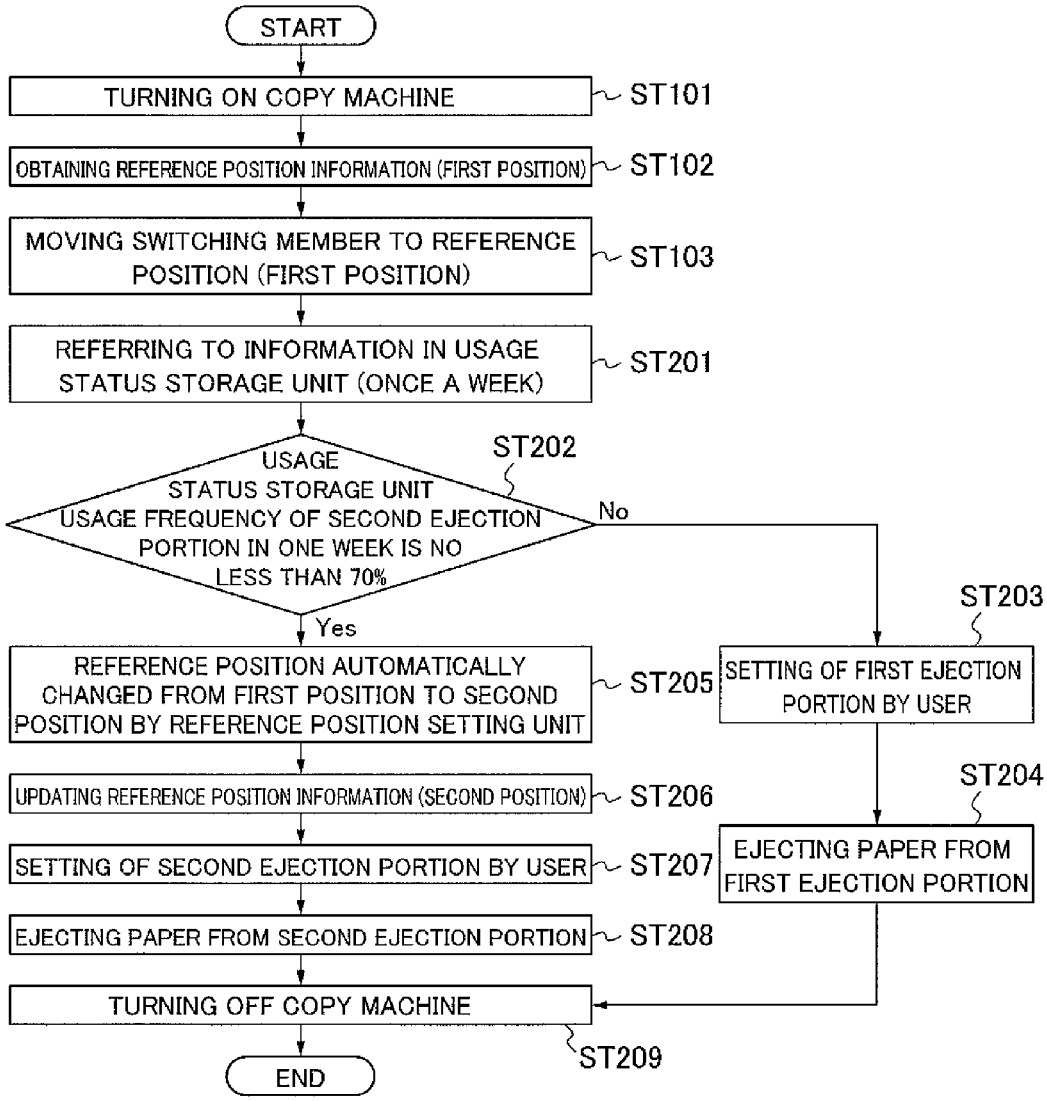
FIG. 7 is a flow chart illustrating operation of a copy machine 1 according to a second embodiment according to information stored in the usage status storage portion 632.

Next, operation of the copy machine 1 according to the second embodiment is described with reference to FIG. 7. FIG. 7 is a flow chart illustrating operation of a copy machine 1 according to a second embodiment according to information stored in the usage status storage portion 632. Steps in the flow chart of the second embodiment are similar to steps ST101 to ST 103 in the flow chart of the first embodiment, therefore, descriptions thereof are omitted in the second embodiment.

The copy machine 1 according to the second embodiment performs control based on information stored in the usage status storage portion 632. In the copy machine 1 according to the second embodiment, a user sets a collection period for collecting usage information in a preliminary phase to the operation of the copy machine 1, and the usage information in the collection period for collecting the usage information can be stored in the usage status storage portion 632.

More specifically, the user inputs the collection period for collecting the usage information via the usage information collection period input unit 614 in the operation unit 610. The usage information collection period input unit 614 outputs information relating to the collection period that is input for collecting the usage information, to the usage information collection period setting unit 627.

The usage information collection period setting unit 627 sets a collection period for collecting the usage information based on the signal output from the usage information collection period input unit 614. The usage information collection period setting unit 627 makes the usage information, in the collection period for collecting the usage information, stored in the number management table storage portion 633 in the usage status storage portion 632.

In the present embodiment, the user sets one week, for example, as the collection period. The usage information collection period setting unit 627 thus makes the usage information of, for example, the switching member 58 for a week to be stored in the number management table storage portion 633.

In addition, the usage information collection period setting unit 627 shortens or prolongs the collection period in a case where usage frequency of the first ejection portion 50*a* or the second ejection portion 50*b* in the collection period is within a predetermined range.

For example, in a case where the collection period is set to be one week, if the usage frequency of the first ejection portion 50*a* is within the predetermined range (45 to 55%), the usage information collection period setting unit 627 prolongs the collection period to two weeks and checks the usage frequency of the first ejection portion 50*a*.

Then, with the collection period being prolonged to two weeks, if the usage frequency of the first ejection portion 50*a* exceeds 55% (the predetermined range), the drive control unit 626 changes (or maintains) the position of the switching member 58 to (at) the first position 58*a*, and if the usage frequency of the first ejection portion 50*a* is less than 45% (the predetermined range), the drive control unit 626 changes (or maintains) the position of the switching member 58 to (at) the second position 58*b*.

It should be noted that the usage information collection period setting unit 627 can further prolong the collection period if the usage frequency of the first ejection portion 50*a* or the second ejection portion 50*b* is within the predetermined range (45 to 55%).

On the contrary, for example, with the collection period being set to be one week, if the usage frequency of the first ejection portion 50*a* is within the predetermined range (45 to 55%), the usage information collection period setting unit 627 can shorten the collection period to three days and check the usage frequency of the first ejection portion 50*a*.

Then, with the collection period being shortened to three days, if the usage frequency of the first ejection portion 50*a* exceeds 55% (the predetermined range), the drive control unit 626 changes (or maintains) the position of the switching member 58 to (at) the first position 58*a*, and if the usage frequency of the first ejection portion 50*a* is less than 45% (the predetermined range), the drive control unit 626 changes (or maintains) the position of the switching member 58 to (at) the second position 58*b*.

It should be noted that the usage information collection period setting unit 627 can further shorten the collection period if the usage frequency of the first ejection portion 50*a* or the second ejection portion 50*b* is within the predetermined range (45 to 55%).

As shown in FIG. 7, after preparing the copy machine 1, the user first switches the copy machine 1 from the power-off state to the power-on state by performing the power-on operation of the power unit 640 via the power switch unit 641 (ST101).

The drive control unit 626 obtains the reference position information stored in the reference position storage portion 631 when the copy machine 1 is switched from the power-off state to the power-on state (ST102).

The drive control unit 626 controls the drive unit 59 based on the reference position information obtained from the reference position storage portion 631. The drive unit 59 moves (maintains) the switching member 58 to (at) the first position 58*a* based on an instruction from the drive control unit 626 (ST103).

The reference position setting unit 621 refers to, for example, a table stored in the number management table storage portion 633 in the usage status storage portion 632 (ST201).

More specifically, the reference position setting unit 621 refers to the table stored in the number management table storage portion 633 once a week. The reference position setting unit 621 changes the reference position of the switching member 58 based on the table in the number management table storage portion 633 (see FIG. 5), and outputs a signal to the reference position storage portion 631.

For example, the reference position setting unit 621 can automatically change the reference position from the first position 58*a* to the second position 58*b* in a case where usage frequency of the second ejection portion 50*b* in a week is no less than 70% of all ejection portions (ST202, Yes).

More specifically, as shown in FIG. 5, in the table in the number management table storage portion 633, usage frequency of the second ejection portion 50*b* in a period of April 12 to April 18 is about 87% of all ejection portions (the first ejection portion 50*a* and the second ejection portion 50*b*). In such a case (ST202, Yes), the reference position setting unit 621 automatically changes the reference position of the switching member 58 from the first position 58*a* to the second position 58*b*, and outputs a signal to the reference position storage portion 631 (ST205).

The reference position storage portion 631 stores the second position 58*b* as the reference position, based on the signal output from the reference position setting unit 621. The reference position stored in the reference position storage portion 631 is thus changed from the first position 58*a* to the second position 58*b* (ST206).

The user selects and sets the second ejection portion 50*b* as the ejection portion of the paper T (ST207).

The specification unit 623 instructs the drive control unit 626 to place the switching member 58 to the second position 58*b*. Since the reference position of the switching member 58 is the second position 58*b*, the drive control unit 626 controls the drive unit 59 to maintain the switching member 58 at the second position 58*b*.

The paper T is carried and guided into the second conveying path L2 by the switching member 58, which is maintained at the second position 58*b*. Then, the paper T is ejected from the second ejection portion 50*b* (ST208). At least one of the switching member 58 and the drive unit 59 does not generate a switching sound since the switching member 58 is not moved by the drive unit 59.

Thereafter, the copy machine 1 is turned off either by an operation of the power switch unit 641 or by auto power-off (ST209).

In the table in the number management table storage portion 633, usage frequency of the second ejection portion 50*b* in a period of April 5 to April 11 is about 47% of all ejection portions (the first ejection portion 50*a* and the second ejection portion 50*b*). In such a case (ST202, No), there is no change in the reference position setting unit 621 and the reference position of the switching member 58 is maintained at the first position 58*a*.

The user selects and sets the first ejection portion 50*a* as the ejection portion of the paper T (ST203).

The specification unit 623 instructs the drive control unit 626 to place the switching member 58 to the first position 58*a*. Since the reference position of the switching member 58 is the first position 58*a*, the drive control unit 626 controls the drive unit 59 to maintain the switching member 58 at the first position 58*a*.

The paper T is carried and guided into the first conveying path L1 by the switching member 58, which is maintained at the first position 58*a*. Then, the paper T is ejected from the first ejection portion 50*a* (ST204). At least one of the switching member 58 and the drive unit 59 does not generate a switching sound since the switching member 58 is not moved by the drive unit 59.

Thereafter, the copy machine 1 is turned off either by an operation of the power switch unit 641 or by auto power-off (ST209).

Figure 8:
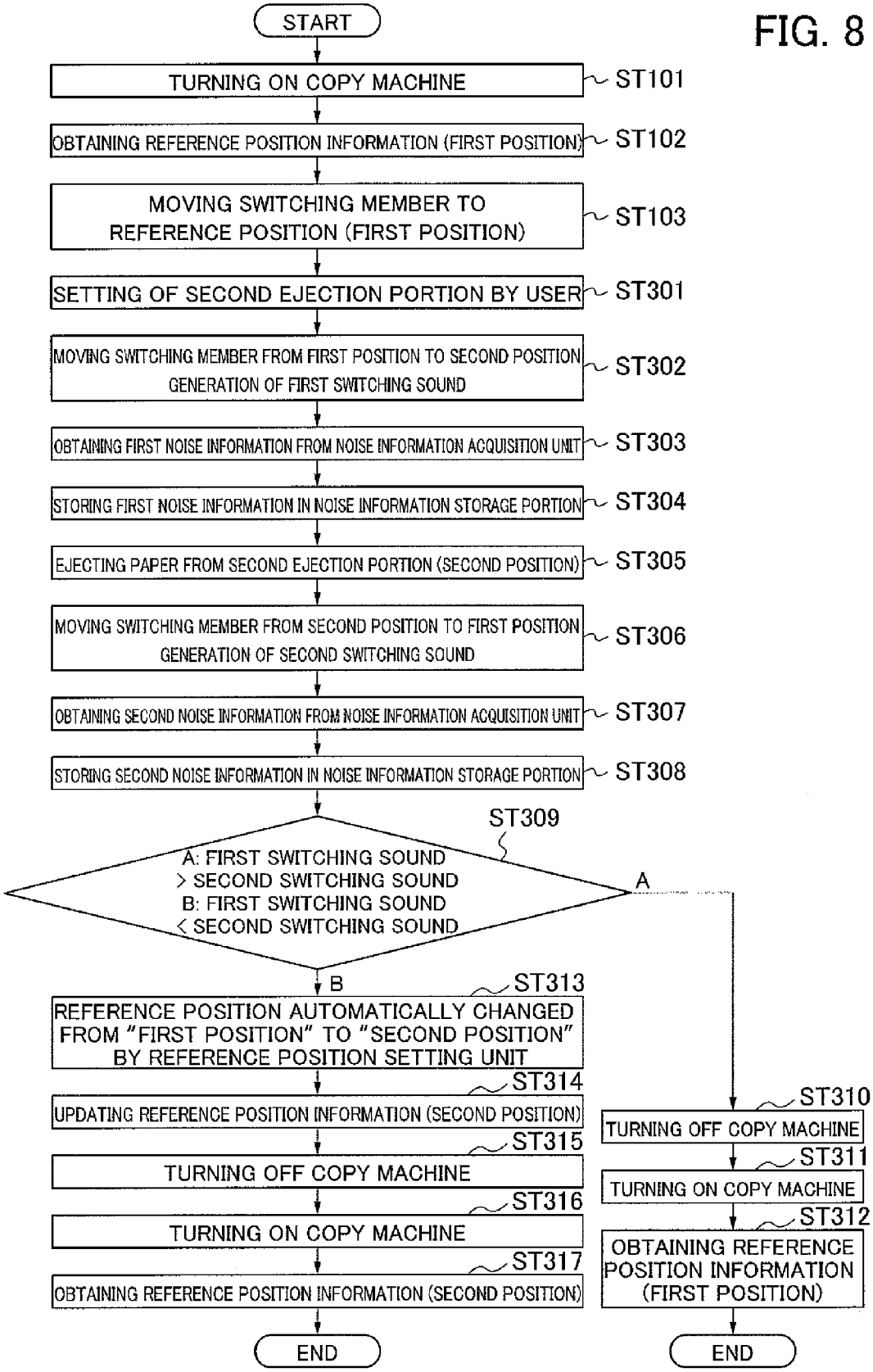
FIG. 8 is a flow chart illustrating operation of a copy machine 1 according to a third embodiment based on information stored in a noise information storage portion 634.

Next, operation of the copy machine 1 according to the third embodiment is described with reference to FIG. 8. FIG. 8 is a flow chart illustrating operation of a copy machine 1 according to a third embodiment based on information stored in a noise information storage portion 634. Steps in the flow chart of the third embodiment are similar to steps ST101 to ST 103 in the flow chart of the first embodiment, therefore, descriptions thereof are omitted in the third embodiment.

As shown in FIG. 8, the user first switches the copy machine 1 from the power-off state to the power-on state by performing the power-on operation of the power unit 640 via the power switch unit 641 (ST101).

The drive control unit 626 obtains the reference position information stored in the reference position storage portion 631 when the copy machine 1 is switched from the power-off state to the power-on state (ST102).

The drive control unit 626 controls the drive unit 59 based on the reference position information obtained from the reference position storage portion 631. The drive unit 59 moves (maintains) the switching member 58 to (at) the first position 58*a* based on an instruction from the drive control unit 626 (ST103).

Next, the user selects and sets the second ejection portion 50*b* as the ejection portion of the paper T, via the ejection portion setting unit 612 in the operation unit 610 (ST301).

The specification unit 623 instructs the drive control unit 626 to place the switching member 58 to the second position 58*b*. The drive control unit 626 controls the drive unit 59 to move the switching member 58 to the second position 58*b*.

The drive unit 59 moves the switching member 58 from the first position 58*a* to the second position 58*b* (ST302). The switching member 58 and/or the drive unit 59 generate the first switching sound accompanying the movement of the switching member 58 from the first position 58*a* to the second position 58*b*.

The noise information acquisition unit 625 obtains first noise information relating to the first switching sound (ST303).

The first noise information obtained by the noise information acquisition unit 625 is stored in the noise information storage portion 634 (ST304).

The paper T is carried and guided into the second conveying path L2 in a state where the switching member 58 is positioned at the second position 58*b*. Then, the paper T is ejected from the second ejection portion 50*b* (ST305).

After ejection of the paper T from the second ejection portion 50*b*, the switching member 58 is moved by the drive unit 59 from the second position 58*b* to the first position 58*a*, which is the reference position (ST306). The switching member 58 and/or the drive unit 59 generates the second switching sound accompanying the movement of the switching member 58 from the second position 58*b* to the first position 58*a* by the drive unit 59.

The noise information acquisition unit 625 obtains second noise information relating to the second switching sound (ST307). The second noise information obtained by the noise information acquisition unit 625 is stored in the noise information storage portion 634 (ST308).

The reference position setting unit 621 compares the first noise information with the second noise information stored in the noise information storage portion 634, and compares loudness of the first switching sound with that of the second switching sound (ST309).

The reference position setting unit 621 sets the first position 58*a* as the reference position in a case where the first switching sound is louder than the second switching sound (ST309, A).

Thereafter, the copy machine 1 is turned off either by an operation of the power switch unit 641 or by auto power-off (ST310).

In order to continue using the copy machine 1, the user turns on the copy machine 1 (ST311).

In such a state, the first position 58*a* is stored in the reference position storage portion 631 as the reference position in the reference position information. The drive control unit 626 obtains the reference position information stored in the reference position storage portion 631 when the copy machine 1 is switched from the power-off state to the power-on state (ST312).

In this case, since the first position 58*a* is selected as the reference position, the first switching sound is generated before ejection of the paper T from the second ejection portion 50*b*, if the paper T is to be ejected from the second ejection portion 50*b*. Then, after the ejection of the paper T from the second ejection portion 50*b*, the second switching sound is generated. As a result, a switching sound as noise can be suppressed in the first switching sound and the second switching sound.

In other words, the reference position setting unit 621 sets the reference position so as to allow a switching operation generating a loud switching sound to be performed in a state where the switching sound would be masked by noise generated upon beginning the image forming operation. In addition, the reference position setting unit 621 sets the reference position so as to allow a switching operation generating a quiet switching sound to be performed in a state where the switching sound would not be masked (the switching sound is outstanding as noise) as the image forming operation is terminated, and thus noise is not generated.

In addition, in a case where the second switching sound is louder than the first switching sound (ST313, B), the reference position setting unit 621 automatically changes the reference position from the first position 58*a* to the second position 58*b*, and outputs a signal to the reference position storage portion 631 (ST313).

The reference position storage portion 631 stores the signal relating to the second position 58*b* output from the reference position setting unit 621 as the reference position in the reference position information. The reference position stored in the reference position storage portion 631 is thus changed from the first position 58*a* to the second position 58*b* (ST314).

Thereafter, the copy machine 1 is turned off either by an operation of the power switch unit 641 or by auto power-off (ST315).

In order to continue using the copy machine 1, the user turns on the copy machine 1 (ST316).

In such a state, the second position 58*b* is stored in the reference position storage portion 631 as the reference position in the reference position information. The drive control unit 626 obtains the reference position information stored in the reference position storage portion 631 when the copy machine 1 is switched from the power-off state to the power-on state (ST317).

In this case, since the first position 58*b* is selected as the reference position, the second switching sound is generated before ejection of the paper T from the first ejection portion 50*a*, if the paper T is to be ejected from the first ejection portion 50*a*. Subsequently, after ejection of the paper T from the first ejection portion 50*a*, the first switching sound is generated. As a result, a switching sound as noise can be suppressed in the first switching sound and the second switching sound.

Figure 9:
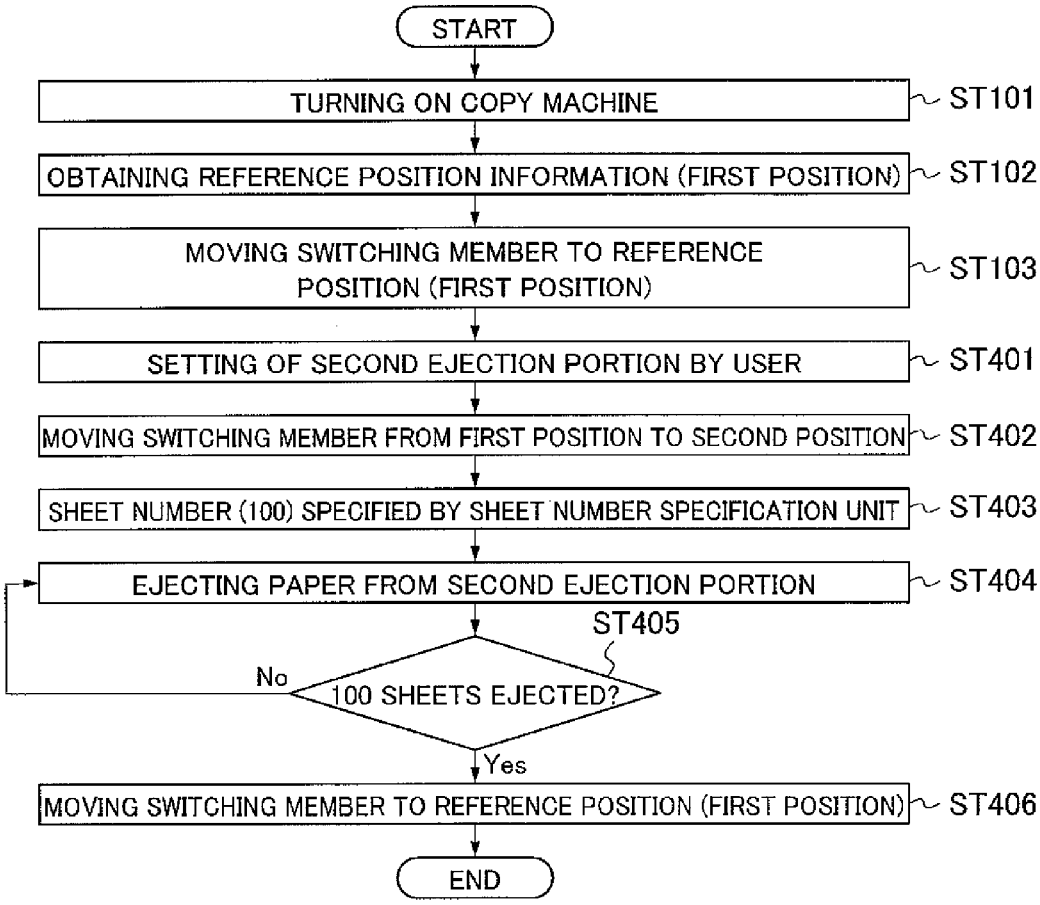
FIG. 9 is a flow chart illustrating operation of a copy machine 1 according to a fourth embodiment in a case where a number is specified by the number specification unit 624.

Next, operation of the copy machine 1 according to the fourth embodiment is described with reference to FIG. 9. FIG. 9 is a flow chart illustrating operation of a copy machine 1 according to a fourth embodiment in a case where a number is specified by the number specification unit. Steps in the flow chart of the fourth embodiment are similar to steps ST101 to ST 103 in the flow chart of the first embodiment, therefore, descriptions thereof are omitted in the fourth embodiment.

As shown in FIG. 9, the user first switches the copy machine 1 from the power-off state to the power-on state by performing, the power-on operation of the power unit 640 via the power switch unit 641 (ST101).

The drive control unit 626 obtains the reference position information stored in the reference position storage portion 631 when the copy machine 1 is switched from the power-off state to the power-on state (ST102).

The drive control unit 626 controls the drive unit 59 based on the reference position information obtained from the reference position storage portion 631. The drive unit 59 moves (maintains) the switching member 58 to (at) the first position 58*a* based on an instruction from the drive control unit 626 (ST103).

Next, the user selects and sets the second ejection portion 50*b* as the ejection portion of the paper T, via the ejection portion setting unit 612 in the operation unit 610 (ST401).

The specification unit 623 instructs the drive control unit 626 to place the switching member 58 to the second position 58*b*. The drive control unit 626 controls the drive unit 59 to move the switching member 58 to the second position 58*b*.

The drive unit 59 moves the switching member 58 from the first position 58*a* to the second position 58*b* (ST402). The switching member 58 and/or the drive unit 59 generates the first switching sound accompanying the movement of the switching member 58 from the first position 58*a* to the second position 58*b*.

Then, the user specifies, for example, "100" as the number of sheets of the paper T to be ejected, to the number specification unit 624 via the number setting unit 613 (ST403).

The number setting specification unit 624 outputs a signal to the drive control unit 626 so as to maintain the switching member 58 at the second position 58*b* until 100 sheets of the paper T are ejected from the second ejection portion 50*b* (ST404).

In this case, in response to a signal from the number specification unit 624, the drive control unit 626 controls the drive unit 59 to maintain the switching member 58 at the second position 58*b* until the 100 sheets of the paper T specified by the number specification unit 624 are ejected from the second ejection portion 50*b* (ST405, No).

The 100 sheets of the paper T are carried and guided into the second conveying path L2 by the switching member 58, which is maintained at the second position 58*b*. Then, the paper T is ejected from the second ejection portion 50*b*. The switching member 58 and/or the drive unit 59 does not generate a switching sound since the switching member 58 is not moved by the drive unit 59. The copy machine 1 quietly ejects the 100 sheets of the paper T successively.

After ejection of the 100 sheets of the paper T from the second ejection portion 50*b* (ST405, Yes), the switching member 58 is moved to the first position 58*a*, which is the reference position (ST406).

It should be noted that, in the present embodiment, the drive control unit 626 controls the drive unit 59 to move the switching member 58 to the second position 58*b* in ST402, however, this can happen after the beginning of image formation after ST403. More specifically, the drive control unit 626 can control the drive unit 59 to move the switching member 58 to the second position 58*b*, after the beginning of image formation on a first sheet of the paper T by the image forming unit and before transfer of the paper T to the first branch portion 01. As a result, the first switching sound accompanying the movement of the switching member 58 from the first position 58*a* to the second position 58*b* becomes difficult for a user to recognize due to an operation sound of the image forming unit. In other words, the drive control unit 626 controls the drive unit 59 so as to allow a switching operation of the switching member 58 in a state where the switching sound would be masked by noise generated upon beginning of the image forming operation.

The image forming apparatus according to the present embodiment provides the following effects.

The image forming apparatus of the present embodiment includes, the first ejection portion 50*a* and the second ejection portion 50*b* that eject the paper T to the outside of the housing 306, the first conveying path L1 that guides the paper T to the first ejection portion 50*a*, the second conveying path L2 that guides the paper T to the second ejection portion 50*b*, the branch portion Q1 that connects the first conveying path L1 with the second conveying path L2, the switching member 58 that is disposed in the branch portion Q1 and movable between the first position 58*a* to direct the paper T, which is discharged to the outside of the apparatus, toward the first conveying path L1 and the second position 58*b* to direct the paper T, which is discharged to the outside of the apparatus, toward the second conveying path L2, the drive unit 59 that moves the switching members 58 from the first position 58*a* to the second position 58*b* or vice versa, the reference position setting unit 621 that sets the reference position of the switching member 58 in an initial state, and the drive control unit 626 that controls the drive unit 59 such that the switching member 58 in the initial state is positioned at the reference position set by the reference position setting unit 621. Therefore, the copy machine 1 of the present invention can change the reference position that is a position at which the switching member is positioned when the copy machine 1 is turned on. In addition, the copy machine 1 of the present invention can suppress generation of noise due to the switching operation of the switching member 58.

In addition, according to the present embodiment, the usage status storage portion 632 is provided that stores usage information including information regarding the position of the switching member 58, and the reference position setting unit 621 sets the reference position of the switching member 58 based on the usage information stored by the usage status storage portion 632. Therefore, the copy machine 1 of the present invention can reduce the frequency of movement of the switching member 58 based on the usage information of a user. As a result, generation of noise due to the switching operation of the switching member 58 can thus be suppressed.

In addition, according to the present embodiment, the usage information collection period setting unit 627, which can set a collection period for collecting the usage information, is provided, and the usage information collection period setting unit 627 makes the usage information, in the collection period set by the usage information collection period setting unit 627, stored in the usage status storage portion 632. Therefore, the copy machine 1 of the present invention can switch the switching member 58 based on the usage information regarding the position of the switching member 58 in the collection period. In such a configuration, even if a user mainly using the copy machine 1 is changed, the copy machine 1 of the present invention can suppress generation of noise due to the switching operation of the switching member 58 according to the usage status of the user in the collection period.

In addition, according to the present embodiment, the usage information collection period setting unit 627 shortens or prolongs the collection period in a case where usage frequency of the first ejection portion 50*a* or the second ejection portion 50*b* in the collection period is within a predetermined range. Therefore, the copy machine 1 according to the present invention can suppress generation of noise due to the switching operation of the switching member 58.

In addition, according to the present embodiment, the number information acquisition unit 622 is provided that obtains number information relating to the number of the paper T ejected from the first ejection portion 50*a* and the number of the paper T ejected from the second ejection portion 50*b*, and the reference position setting unit 621 sets the reference position of the switching member 58 based on the number information obtained by the number information acquisition unit 622. Therefore, the copy machine 1 of the present invention can reduce the frequency of the switching operation of the switching member 58 based on the number information regarding the number of sheets of the paper T ejected. Generation of noise due to the switching operation of the switching member 58 can thus be suppressed.

In addition, according to the present embodiment, the change operation unit 611 is provided that can instruct the reference position setting unit 621 to change the reference position. This allows a user to easily instruct the reference position setting unit 621 to change the reference position, via the change operation unit 611.

In addition, according to the present embodiment, the image information acquisition unit 625 is provided that obtains information relating to the first switching sound generated when the switching member 58 is moved from the first position 58*a* to the second position 58*b*, and the second switching sound generated when the switching member 58 is moved from the second position 58*b* to the first position 58*a*, and the reference position setting unit 621 refers to the noise information obtained from the noise information acquisition unit 625, and sets the first position 58*a* as the reference position in a case where the first switching sound is louder than the second switching sound, and sets the second position 58*b* as the reference position in a case where the second switching sound is louder than the first switching sound. As a result, the reference position setting unit 621 allows a switching operation generating a loud switching sound in a state where the switching sound would be masked by noise generated upon beginning of the image forming operation. In addition, the reference position setting unit 621 can set the reference position so as to allow a switching operation generating a quiet switching sound in a state where the switching sound would not be masked (the switching sound is outstanding as noise) as the image forming operation is terminated and thus noise is not generated. As a result, the copy machine 1 can make the switching sound of the switching member 58, as noise after ejection of the paper T, quieter as a whole.

In addition, according to the present embodiment, the specification unit 623 that can specify the position of the switching member 58, and the number specification unit 624 that specifies the number of sheets of the paper T on which an image is to be formed by the image forming unit at a position specified by the specification unit 623 are provided, and the drive control unit 626 controls the drive unit 59 to maintain the switching member 58 at the position specified by the specification unit 623 until the number of sheets of the paper T specified by the number specification unit 624 is carried into the first conveying path L1 or the second conveying path L2 by the switching member 58. Therefore, the copy machine 1 can successively eject the specified number of sheets of the paper T from the first ejection portion 50*a* or the second ejection portion 50*b* without switching the position of the switching member 58. Therefore, there is no generation of sound upon switching of the position of the switching member 58, and deterioration of members operating upon switching of the position of the switching member 58 can be reduced.

Preferred embodiments of the present invention have been described above, however, the present invention is not limited thereto and can be carried out in various modes.

For example, in the abovementioned embodiments, the first switching sound and the second switching sound are described as the contact sound between the switching member 58 and the peripheral members and/or the operation sound of the drive unit 59, however, the present invention is not limited thereto.

In addition, in the description of the operation of the copy machine 1 in the abovementioned embodiment, the reference position upon power-on of the copy machine 1 is the first position 58*a*, however, the present invention is not limited thereto, and the reference position upon power-on can also be the second position 58*b*.

Furthermore, the present invention is not limited to the abovementioned embodiments and can be carried out in various modes. For example, the copy machine 1 is exemplified in the present embodiments as an image forming apparatus, the copy machine 1 including a color copy machine and a black and white copy machine. In addition, the image forming apparatus is not limited thereto and can be a copy machine, a printer, a facsimile machine, and a multi-functional printer having functions thereof.

What is claimed is:

1. An image forming apparatus comprising:

a housing;

an image forming unit that forms an image on a recording medium to which the image is transferred;

a first ejection portion and a second ejection portion that eject the recording medium to the outside of the housing;

a first conveying path that guides the recording medium to the first ejection portion;

a second conveying path that guides the recording medium to the second ejection portion;

a branch portion that connects the first conveying path with the second conveying path;

a switch that is disposed in the branch portion and movable between a first position to direct the recording medium, which is to be discharged to the outside of the apparatus, toward the first conveying path, and a second position to direct the recording medium, which is to be discharged to the outside of the apparatus, toward the second conveying path;

a drive unit that moves the switch from the first position to the second position or from the second position to the first position;

a reference position setting unit that sets a reference position of the switch, the reference position being a position that the switch is controlled to take in an initial state;

a control unit that controls the drive unit such that the switch in the initial state is positioned at the reference position set by the reference position setting unit; and a usage status storage portion that stores usage information including information regarding a position of the switch, wherein the reference position setting unit sets the reference position of the switch based on the usage information stored by the usage status storage portion.

2. The image forming apparatus according to claim 1, further comprising:

a usage information collection period setting unit that can set a collection period, which is a predetermined period for collecting the usage information, and that makes the usage status storage portion store the usage information during the set collection period.

3. The image forming apparatus according to claim 2, wherein the usage information collection period setting unit shortens or prolongs the collection period in a case where usage frequency of the first ejection portion or the second ejection portion in the collection period is within a predetermined range.

4. The image forming apparatus according to claim 1, further comprising:

a number information acquisition unit that obtains number information relating to a number of the recording mediums ejected from the first ejection portion and a number of the recording mediums ejected from the second ejection portion, the number of the recording mediums ejected from the first and second ejection portions making up at least part of the usage information, wherein the reference position setting unit sets the reference position of the switch based on the number information obtained by the number information acquisition unit.

5. A method of forming an image using the image forming apparatus according to claim 1, comprising:

setting the reference position of the switch;

controlling the drive unit such that the switch in the initial state is positioned at the reference position;

forming a first image on a first recording medium to which the image is transferred;

directing the first recording medium toward the first conveying path in order to discharge the recording medium, guiding the first recording medium to the first ejection portion;

ejecting the first recording medium to the outside of the housing;

moving the switch from the first position to the second position or from the second position to the first position;

forming a second image on a second recording medium to which the image is transferred;

directing the second recording medium toward the second conveying path in order to discharge the recording medium;

guiding the second recording medium to the second ejection portion; and ejecting the second recording medium to the outside of the housing.

6. A method for conveying a recording medium with an image forming apparatus that is configured to selectively eject the recording medium on which an image is formed to a first ejection portion and a second ejection portion by selectively switching a switch disposed in a conveying path to a first position and a second position, the method comprising:

memorizing information on a reference position where the switch is to be located at an initial time when a power unit of the image forming apparatus is turned on from off;

turning on the power unit;

acquiring the memorized information on the reference position;

moving the switch to the reference position;

setting an ejection destination of the recording medium to one of the first ejection portion and the second ejection portion;

moving the switch to one of the first position and the second position from the reference position if the reference position does not agree with a position of the switch corresponding to the ejection destination of the recording medium;

forming an image on the recording medium;

conveying and guiding the recording medium to an ejection portion selected for the recording medium from the first ejection portion and the second election portion;

ejecting the recording medium outside from the ejection portion selected for the recording medium;

storing usage information including information regarding a position of the switch; and setting the reference position of the switch based on the stored usage information.

* * * * *